US009488022B2

(12) United States Patent
Alix et al.

(10) Patent No.: US 9,488,022 B2
(45) Date of Patent: Nov. 8, 2016

(54) OVERSHOT

(75) Inventors: Philippe Alix, St-Jean-sur-Richelieu (CA); Martin Jolicoeur, Lachine (CA); Jacques Carriere, Preissac (CA)

(73) Assignee: GROUPE FORDIA INC., Dollard-Des (CA)

( * ) Notice: Subject to any disclaimer, the term of this patent is extended or adjusted under 35 U.S.C. 154(b) by 261 days.

(21) Appl. No.: 14/008,054

(22) PCT Filed: Mar. 29, 2012

(86) PCT No.: PCT/CA2012/000284

§ 371 (c)(1),
(2), (4) Date: Oct. 28, 2013

(87) PCT Pub. No.: WO2012/129662

PCT Pub. Date: Oct. 4, 2012

(65) Prior Publication Data

US 2014/0311733 A1 Oct. 23, 2014

Related U.S. Application Data

(60) Provisional application No. 61/457,452, filed on Mar. 31, 2011.

(51) Int. Cl.

| | |
|---|---|
| ***E21B 31/18*** | (2006.01) |
| ***E21B 31/20*** | (2006.01) |
| ***E21B 31/12*** | (2006.01) |
| ***E21B 31/00*** | (2006.01) |

(52) U.S. Cl.

CPC ..... *E21B 31/18* (2013.01); *E21B 31/00* (2013.01); *E21B 31/12* (2013.01); *E21B 31/20* (2013.01)

(58) Field of Classification Search

CPC ..... E21B 31/18; E21B 31/12; E21B 31/20; E21B 31/00

See application file for complete search history.

(56) References Cited

U.S. PATENT DOCUMENTS

| | | | | |
|---|---|---|---|---|
| 1,570,065 A | | 1/1926 | Jones | |
| 1,697,590 A | | 1/1929 | Dodds | |
| 1,719,144 A | * | 7/1929 | Stoke | E21B 31/18 294/86.2 |
| 2,266,873 A | | 12/1941 | Lang | |
| 2,296,397 A | | 9/1942 | Muhlbach | |
| 2,507,127 A | | 5/1950 | True | |

(Continued)

FOREIGN PATENT DOCUMENTS

| | | |
|---|---|---|
| WO | 2007041778 | 4/2007 |
| WO | 2008095233 | 8/2008 |

*Primary Examiner* — Yong-Suk (Philip) Ro

(57) ABSTRACT

An overshot (10, 100, 200) for handling equipment (12) defining a spearhead point (14). The overshot (10, 100, 200) includes: a substantially elongated overshot body (16); a pair of lifting dogs (18) pivotally mounted to the overshot body (16) so as to be movable between a dog closed configuration and a dog open configuration; and a dog control element (26) operatively coupled to the lifting dogs (18) for selectively controlling the movement of the lifting dogs (18) between the dog closed and open configurations, the dog control element (26) being operable between an armed configuration, a locked configuration and a released configuration. In the armed configuration, the lifting dogs (18) are movable between the dog closed and open configurations for allowing insertion of the spearhead point (14) therebetween; in the locked configuration, the lifting dogs (18) are locked in the dog closed configuration; and in the released configuration, the lifting dogs (18) are positioned in the dog open configuration.

46 Claims, 22 Drawing Sheets

(56) References Cited

U.S. PATENT DOCUMENTS

| | | | | | |
|---|---|---|---|---|---|
| 3,627,067 | A | | 12/1971 | Martinsen | |
| 3,704,755 | A | | 12/1972 | Wolda | |
| 3,758,145 | A | | 9/1973 | Kinley | |
| 3,930,679 | A | | 1/1976 | Anderson et al. | |
| 4,004,835 | A | * | 1/1977 | Taylor | E21B 31/18 294/86.29 |
| 4,281,725 | A | * | 8/1981 | Runk | E21B 31/18 175/246 |
| 4,436,334 | A | | 3/1984 | Rathburn | |
| 4,885,123 | A | | 12/1989 | Ikeuchi et al. | |
| 5,592,994 | A | * | 1/1997 | Laporte | E21B 23/08 175/247 |
| 6,109,373 | A | | 8/2000 | Able | |
| 6,564,885 | B2 | | 5/2003 | Attwater | |
| 6,820,703 | B1 | | 11/2004 | Borg | |
| 6,997,493 | B2 | | 2/2006 | Beach | |
| 7,427,091 | B2 | | 9/2008 | Streater et al. | |
| 2002/0157872 | A1 | * | 10/2002 | Attwater | E21B 23/08 175/57 |
| 2004/0195852 | A1 | | 10/2004 | Beach | |
| 2009/0242203 | A1 | * | 10/2009 | Pardey | E21B 31/18 166/301 |

* cited by examiner

OVERSHOT

This application claims priority from U.S. Provisional Patent Application Ser. No. 61/457,452 filed on Mar. 31, 2012, the contents of which is hereby incorporated by reference in its entirety.

FIELD OF THE INVENTION

This invention relates to the retrieval of devices in bore holes. More particularly, the invention relates to an overshot.

BACKGROUND OF THE INVENTION

An overshot is a device used in the drilling industry to retrieve core barrels and other equipment from a downhole location. Typically, the equipment to retrieve defines a spearhead point pointing generally upwardly to which the overshot can lock.

The overshot typically includes a pair of pivotally mounted lifting dogs that can be spread apart temporarily to receive the spearhead point therebetween. For safety and efficiency reasons, there is a need for very securely maintaining the spearhead point between the lifting dogs. Many currently existing overshots do not satisfy this requirement. A related requirement is that the overshot easily binds to the spearhead point. Existing overshots sometime present a manual operation to secure attachment of the overshot the spearhead point, which can sometimes fail.

Finally, once the equipment as been retrieved, there is a need to remove the equipment from the overshot. Many currently existing overshots present the possibility of causing injuries to workers during that process, for example when the overshot and the core barrel are over the head of the operator.

Against this background, there exists a need in the industry to provide an improved overshot.

An object of the present invention is therefore to provide an improved overshot.

SUMMARY OF THE INVENTION

In a broad aspect, the invention provides an overshot for handling equipment defining a spearhead point, the overshot comprising: a substantially elongated overshot body defining a body proximal end and a substantially longitudinally opposed body distal end; a pair of lifting dogs, the lifting dogs being substantially elongated and extending along the overshot body, the lifting dogs defining each a dog proximal section, a dog distal section substantially opposed thereto and a dog intermediate section extending therebetween, the lifting dogs being pivotally mounted to the overshot body in the dog intermediate section so as to be movable between a dog closed configuration and a dog open configuration, the dog distal sections being configured and sized for allowing latching of the spearhead point therebetween when the lifting dogs are in the dog closed configuration, the dog distal sections being spread apart from each other to a greater extent in the dog open configuration than in the dog closed configuration for allowing substantially free movements of the spearhead point therebetween; and a dog control element operatively coupled to the lifting dogs for selectively controlling the movement of the lifting dogs between the dog closed and open configurations, the dog control element being operable between an armed configuration, a locked configuration and a released configuration. In the armed configuration, the lifting dogs are movable between the dog closed and open configurations for allowing insertion of the spearhead point therebetween; in the locked configuration, the lifting dogs are locked in the dog closed configuration; and in the released configuration, the lifting dogs are positioned in the dog open configuration.

In some embodiments of the invention, the overshot includes a biasing element operatively coupled to the lifting dogs for biasing the lifting dogs towards the dog closed configuration.

In some embodiments of the invention, the dog control element includes an outer control element provided outside of the overshot body operative for selectively limiting outwardly directed movements of the dog proximal sections, the outer control element being movable substantially longitudinally along the overshot body, the outer control element being distally biased. The outer control element defines a pair of control element apertures extending laterally therethrough, the outer control element defining an outer control element distal end section provided distally relative to the control element apertures. The lifting dogs define each a laterally extending dog protrusion in the dog proximal section, the dog protrusion extending laterally outside of the overshot body when the lifting dogs are in the dog closed configuration, the dog protrusion being retracted in the overshot body when the lifting dogs are in the dog open configuration, the dog protrusion defining a ledge extending substantially perpendicularly to the overshot body and laterally outwardly relative thereto in the dog closed configuration. In the armed configuration, the outer control element distal end section is in register with the dog proximal section proximally relative to the dog protrusion and abuts against the ledge. In the closed configuration, the outer control element distal end section is in register with the dog proximal section distally relative to the dog protrusion and the control element apertures receive the dog protrusions. In the released configuration, the outer control element distal end section is in register with the dog protrusion, thereby moving the lifting dogs to the dog open configuration.

In some variants, the dog control element includes a trigger operative for automatically configuring the dog control element from the armed configuration to the locked configuration when the spearhead point is latched between the dog distal sections with the dog control element in the armed configuration. The dog control element automatically achieves the armed configuration when the dog control element is moved to the released configuration and is subsequently released.

For example, the trigger is movable along the overshot body, the spearhead point abutting against the trigger and moving the trigger towards the body proximal end when the spearhead point is inserted between the lifting dogs, movement of the trigger towards the body proximal end causing the dog control element to achieve the locked configuration. In some embodiments of the invention, the trigger is at least in part provided between the dog distal sections.

In some variants, the dog control element includes an outer control element operative for selectively limiting outwardly directed movements of the dog proximal sections. In some variants, the dog control element includes an inner control element operative for selectively limiting inwardly directed movements of the dog proximal sections. In some variants, the dog control element includes both the inner and outer control elements.

For example, the outer control element is movable substantially longitudinally along the overshot body, the outer control element defining an outer control element first section and an outer control element second section, the outer control element first and second sections being provided laterally outwardly relative to the lifting dogs and longitudinally offset relative to each other, the outer control element first section being configured and sized to allow the lifting dogs to achieve the dog closed configuration when moved in register with the dog proximal sections, the outer control element second section being configured and sized to force the lifting dogs to achieve the dog open configuration when moved in register with the dog proximal sections.

In some embodiments of the invention, the outer control element first section is proximally located relative to the outer control element second section and the outer control element includes a sleeve movable longitudinally along the the overshot body. The sleeve has a larger inner diameter in the outer control element first section than in the outer control element second section.

For example, the inner control element is movable substantially longitudinally along the overshot body and defines an inner control element first section and an inner control element second section, the inner control element first and second sections being substantially longitudinally offset relative to each other and provided laterally inwardly relative to the lifting dogs, the inner control element first section being configured and sized to prevent the lifting dogs from achieving the dog open configuration when moved in register with the dog proximal sections, the inner control element second section being configured and sized to allow the lifting dogs to achieve the dog open configuration when moved in register with the dog proximal sections with the inner control element first section retracted from between the dog proximal sections.

In some embodiments of the invention, the inner control element first section is proximally located relative to the inner control element second section. The inner control element extends laterally outwardly to a greater extent in the inner control element first section than in the inner control element second section in a plane including the lifting dogs.

In some embodiments of the invention, the inner control element is configured and sized to prevent the lifting dogs from achieving the dog open configuration when moved between the dog proximal sections. The dog proximal sections abut against the inner control element when the inner control element is inserted therebetween with the lifting dogs in the dog closed configuration.

In some variants, the inner and outer control elements are jointly movable longitudinally along the overshot body and the inner and outer control elements are biased towards the body distal end.

In some embodiments of the invention, the dog control element includes an arming element operative for selectively preventing movement of the inner and outer control elements towards the body distal end when the inner and outer control elements are positioned proximally to a predetermined longitudinal position so as to maintain the dog control element in the armed configuration.

For example, the arming element includes a trigger and a locking element, the trigger is movable between a trigger first position and a trigger second position, the trigger being configured and sized for moving from the trigger first position to the trigger second position when the spearhead point is inserted between the lifting dogs, the locking element is movable between a locking element extended position and a locking element retracted position, the locking element being in the locking element extended position when the trigger is in the trigger first position and the locking element being in the locking element retracted position when the trigger is in the trigger second position, and, in the locking element extended position, the locking element extends across a path of travel of the outer control element as the outer control element moves from an outer element proximalmost position to an outer element distalmost position, and in the locking element retracted position, the locking element is retracted from the path of travel. When the trigger moves from the trigger first position to the trigger second position, the locking element moves from the locking element extended position to the locking element retracted position, thereby allowing distally oriented movements of the outer control element beyond the predetermined longitudinal position to configure the dog control element to the locked configuration.

In a specific example, the trigger includes a spearhead receiving section provided between the lifting dogs for receiving part of the spearhead point, a trigger released section provided proximally with respect to the spearhead receiving section and a trigger engaged section provided proximally with respect to the trigger released section. The locking element includes a pin provided laterally outwardly with respect to the trigger released and engaged sections, the pin being moved between a pin retracted position and a pin extended position when the locking element is moved respectively to the locking element retracted and extended positions such that the pin is respectively retracted from and extending across the path of travel of the outer control element, the pin being biased towards the trigger and abutting thereagainst. The trigger extends towards the pin to a greater extent in the trigger engaged section than in the trigger released section. Moving the trigger between the trigger first and second positions moves respectively the trigger engaged and released sections in register with the pin to move the pin respectively to the pin extended and retracted positions.

In some very specific examples, the trigger defines a trigger transition section extending between the trigger engaged and released sections, the trigger transition section defining a slanted surface obliquely oriented relative to the overshot body and providing a smooth transition between the trigger engaged and released sections to guide the pin therealong as the trigger is moved between the trigger first and second positions. The spearhead receiving section defines a spearhead receiving recess extending longitudinally thereinto for receiving an apex of the spearhead point thereinto.

In some very specific examples, the trigger is biased towards the trigger first position. The locking element includes a wing, the wing defining a wing proximal end and a substantially opposed wing distal end, the wing being pivotally mounted to the trigger substantially adjacent the wing proximal end. The overshot body defines a wing receiving passageway extending laterally therethrough, the wing being mounted in the wing receiving passageway. The wing distal end protrudes from the wing receiving passageway when the trigger is in the trigger first position and the wing distal end being retracted in the wing receiving passageway when the trigger is in the trigger second position.

In some embodiments of the invention, the dog intermediate and distal sections are substantially rectilinear and substantially collinear with each other. In some embodiments of the invention, the dog distal section is substantially hook shaped and defines a spearhead receiving recess, the spearhead receiving recesses of the lifting dogs facing each other and being provided for receiving the spearhead point therebetween. In some embodiments of the invention, the dog proximal section is substantially V-shaped and includes proximal section first and second segments, the proximal section first segment extending from the dog intermediate section and the proximal section second segment extending from the proximal section first segment, the proximal section second segment being substantially parallel to the dog distal section and being provided at a laterally outward location relatively thereto.

In some variants, the overshot defines a fluid flow passageway extending longitudinally in the overshot from substantially adjacent the body proximal end and emerging laterally from the overshot at a location proximal relative to the body distal end, the overshot further comprising a valve movable between a valve open position and a valve closed position for respectively selectively allowing and preventing flow of a fluid through the fluid flow passageway. Typically, the valve is in the valve open position when the dog control element is in the locked configuration and the valve is in the valve closed position when dog control element is in the armed configuration. For example, the inner control element is inserted in the fluid flow passageway when the valve is in the valve closed position and the inner control element being retracted from the fluid flow passageway when the valve is in the valve closed position.

In some variants, a proximal attachment is provided for attaching a cable thereto and an overload safeguard is operatively coupled to the proximal attachment and to the dog control element for automatically configuring the dog control element from the locked configuration to the released configuration when a proximally oriented force larger than a predetermined overload force is exerted on the proximal attachment by the cable.

For example, the overload safeguard includes a safeguard control element actuator operatively coupled to the dog control element to move the dog control element to the released configuration when the proximally oriented force larger than the predetermined overload force is exerted on the proximal attachment, the safeguard control element actuator being movable between a safeguard control element deactivated configuration and a safeguard control element activated configuration, wherein, in the safeguard control element deactivated configuration, the dog control element if free to move between the armed and locked configurations, and, in the safeguard control element activated configuration, the dog control element is forced to achieve the released configuration.

In a specific example, the inner and outer control elements are proximally located when the dog control element is in the released configuration relative to when the dog control element is in the armed and locked configurations. The safeguard control element actuator is movable longitudinally relative to the overshot body and mechanically coupled to the proximal attachment so that proximally directed forces exerted on the proximal attachment are conveyed to the safeguard control element actuator, the safeguard control element actuator moving in a proximal direction when the safeguard control element actuator moves from the safeguard control element deactivated configuration to the safeguard control element activated configuration, the safeguard control element actuator being biased in a distal direction so that the safeguard control element actuator remains in the safeguard control element deactivated configuration unless the predetermined overload force is exerted on the proximal attachment. The safeguard control element actuator is mechanically coupled to the inner control element for moving the inner control element in a proximal direction when the safeguard control element actuator is moved from the safeguard control element deactivated configuration to the safeguard control element activated configuration.

The inner control element defines a laterally extending inner control element-to-safeguard coupler. The safeguard control element actuator defines a substantially longitudinally elongated control element actuator slot receiving the inner control element-to-safeguard coupler thereinto, the control element actuator slot defining an actuator slot proximal end and a substantially longitudinally opposed actuator slot distal end. In the safeguard control element deactivated configuration, the inner control element-to-safeguard coupler is movable along the control element actuator slot. In the safeguard control element activated configuration the inner control element-to-safeguard coupler abutting against the actuator slot distal end and the safeguard control element actuator pulls on the inner control element to move the dog control element to the released configuration.

In a specific example, the overshot body defines a body passageway extending longitudinally therethrough and a safeguard flange provided in the body passageway proximally relative to the safeguard control element actuator, the overload safeguard further comprising a stack of Belleville washers extending between the safeguard flange and the safeguard control element actuator for biasing the safeguard control element actuator towards the body distal end.

In some variants, the overshot includes a remote unlocking actuator for selectively moving the dog control element from the locked configuration to the released configuration. The remote unlocking actuator is configurable in a remote actuator active configuration and in a remote actuator inactive configuration. In the remote actuator active configuration, the remote unlocking actuator is operable to selectively move the dog control element from the locked configuration to the released configuration. In the remote actuator inactive configuration, the remote unlocking actuator is inoperable to selectively move the dog control element from the locked configuration to the released configuration.

In some examples of implementation, the outer control element is proximally located when the dog control element is in the released configuration relative to when the dog control element is in the armed and locked configurations. The remote unlocking actuator is provided proximally relative to the outer control element and includes an outer control element coupler for coupling the remote unlocking actuator and the outer control element to each other so that the remote unlocking actuator and the outer control element are jointly movable, the remote unlocking actuator being movable longitudinally relative to the overshot body between an unlocking actuator disengaged position and an unlocking actuator engaged position, wherein, with the remote unlocking actuator in the remote actuator active configuration, in the unlocking actuator disengaged position, the remote unlocking actuator and the outer control element are movable independently from each other and in the unlocking actuator engaged position, the outer control element coupler is coupled to the outer control element so that the remote unlocking actuator and the outer control element are movable jointly.

For example, the overshot body includes a longitudinally extending shaft provided proximally to the outer control element, the remote unlocking actuator being mounted to the shaft so as to be longitudinally movable therealong.

For example, the outer control element coupler includes a hook attachable to the outer control element. The outer control element includes a sleeve defining a sleeve outer wall and a sleeve flange extending radially inwardly from the sleeve outer wall, the hook being hookable to the sleeve flange.

For example, the hook is movable between a hook retracted position wherein the hook is movable longitudinally relative to the sleeve flange when adjacent thereto and a hook extended position wherein the hook is hookable to the sleeve flange when positioned inside the sleeve distally relative to the sleeve flange.

For example, the remote unlocking actuator includes a remote unlocking actuator body mounted to the shaft so as to be longitudinally movable therealong, the hook being mounted to the remote unlocking actuator body and positionable relative thereto between a hook active position and a hook inactive position. In the hook active position, the remote unlocking actuator is in the remote actuator active configuration. In the hook inactive position, the remote unlocking actuator is in the remote actuator inactive configuration.

In another broad aspect, the invention provides an overshot for handling equipment defining an equipment handling attachment, the overshot comprising: a substantially elongated overshot body defining a body proximal end and an opposed body distal end; a pair of lifting dogs, the lifting dogs defining each a dog proximal section, a dog distal section substantially opposed thereto and a dog intermediate section extending therebetween, the lifting dogs being pivotally mounted to the overshot body in the dog intermediate section so as to be movable between a dog closed configuration and a dog open configuration, the dog distal sections being configured and sized for allowing latching of the equipment handling attachment therebetween when the lifting dogs are in the dog closed configuration, the dog distal sections being spread apart from each other to a greater extent in the dog open configuration than in the dog closed configuration for allowing substantially free movements of the equipment handling attachment therebetween when the lifting dogs are in the dog open configuration; and a dog control element operatively coupled to the lifting dogs for selectively controlling the movement of the lifting dogs between the dog closed and open configurations, the dog control element being operable between an armed configuration, a locked configuration and an released configuration. In the armed configuration, the lifting dogs are movable between the dog closed and open configurations for allowing insertion of the equipment handling attachment therebetween. In the locked configuration, the lifting dogs are locked in the dog closed configuration. In the released configuration, the lifting dogs are positioned in the dog open configuration.

An example of equipment is a core barrel. An example of the handling equipment attachment is a spearhead point provided at the proximal end of the equipment.

Advantageously, the proposed overshot locks securely the spearhead point between the lifting dogs, while providing a relatively easy and safe manner of spreading the dog distal sections from each other for removal of the spearhead point.

Furthermore, the proposed overshot is relatively robust and is therefore at relatively low risk of being damaged during operation.

Other objects, advantages and features of the present invention will become more apparent upon reading of the following non-restrictive description of preferred embodiments thereof, given by way of example only with reference to the accompanying drawings.

Figure 1:
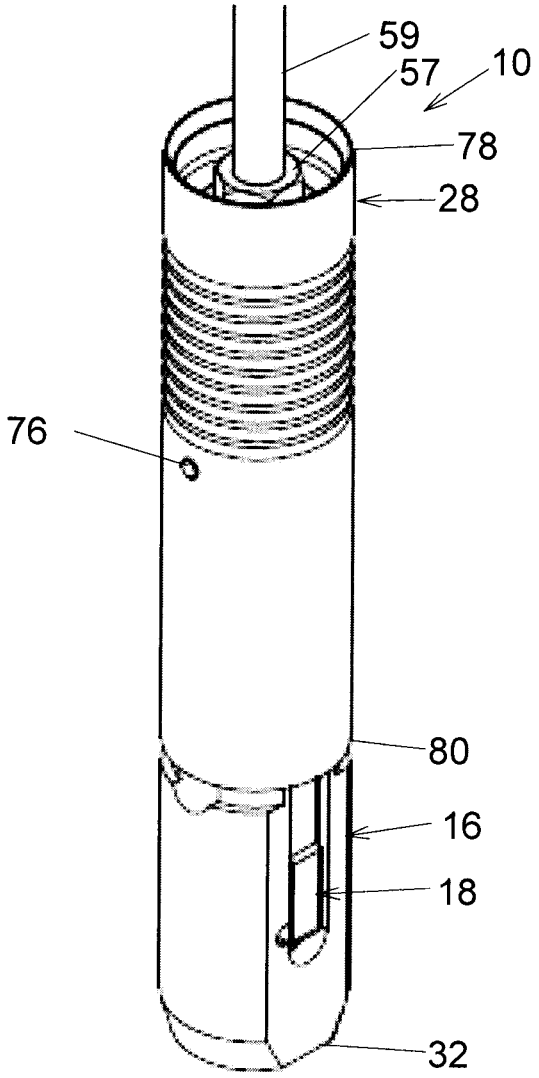
FIG. 1, in a perspective view, illustrates and overshot in accordance with an embodiment of the present invention.

All the cross-sectional views are taken in the middle of the overshot.

DETAILED DESCRIPTION

Referring to FIGS. 1 to 7, there is shown an overshot 10 in accordance with an embodiment of the present invention. With reference to FIGS. 2 to 7, the overshot 10 is usable for retrieving equipment 12 defining a spearhead point 14, the equipment 12 being represented schematically in the drawings. However, in alternative embodiments of the invention, the overshot 10 is usable for handling equipment 12 defining any suitable equipment handling attachment to which the overshot 10 can be attached. The overshot 10 includes an overshot body 16, a pair of lifting dogs 18 pivotally mounted to the overshot body 16 and a dog control element 26 operatively coupled to the lifting dogs 18 for selectively controlling the movement of the lifting dogs 18.

Figure 3:
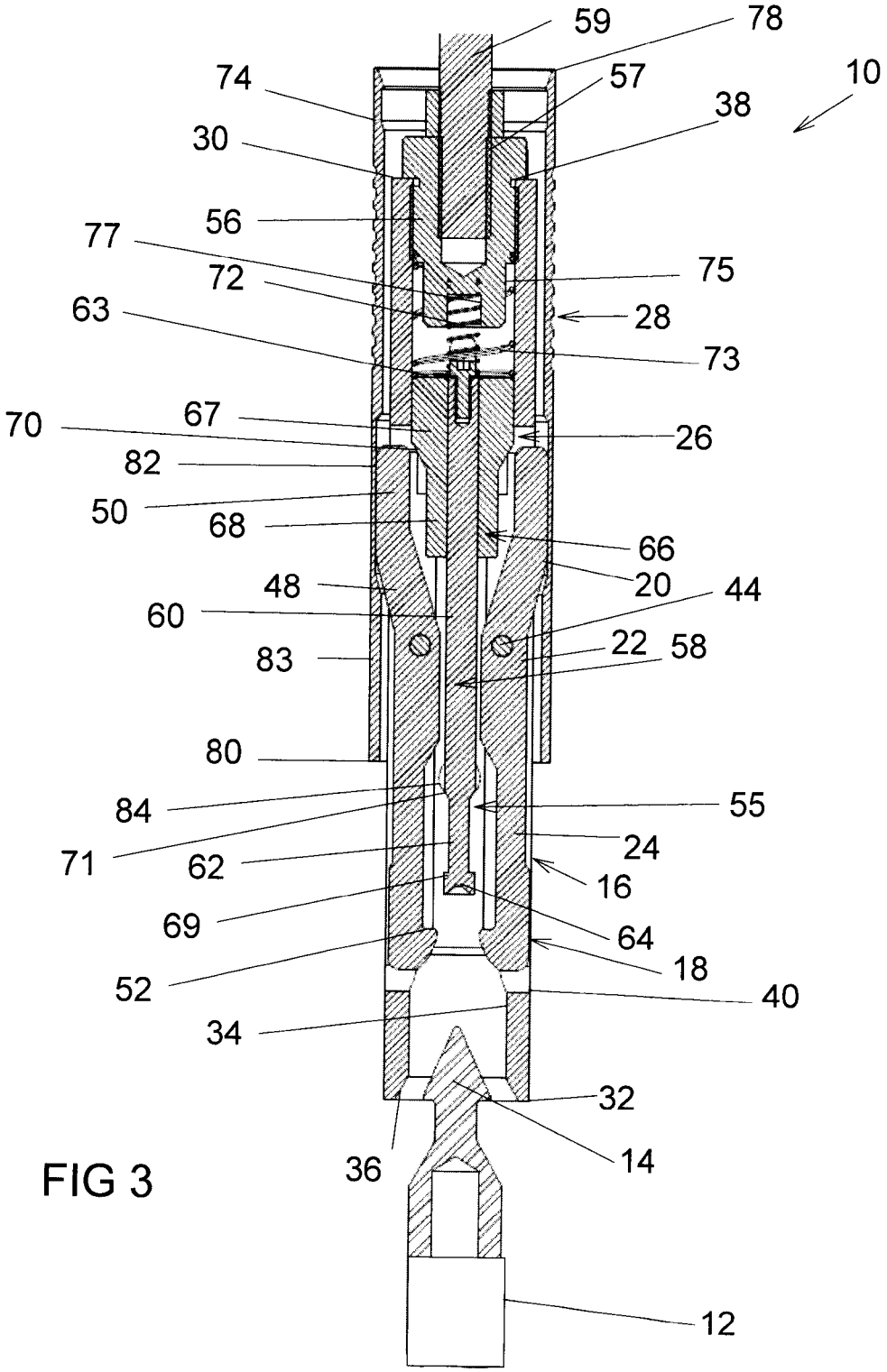
FIG. 3, in a side cross-sectional view, illustrates the overshot shown in FIGS. 1 and 2, the overshot being shown with the dog control element in the armed configuration.
Figure 5:
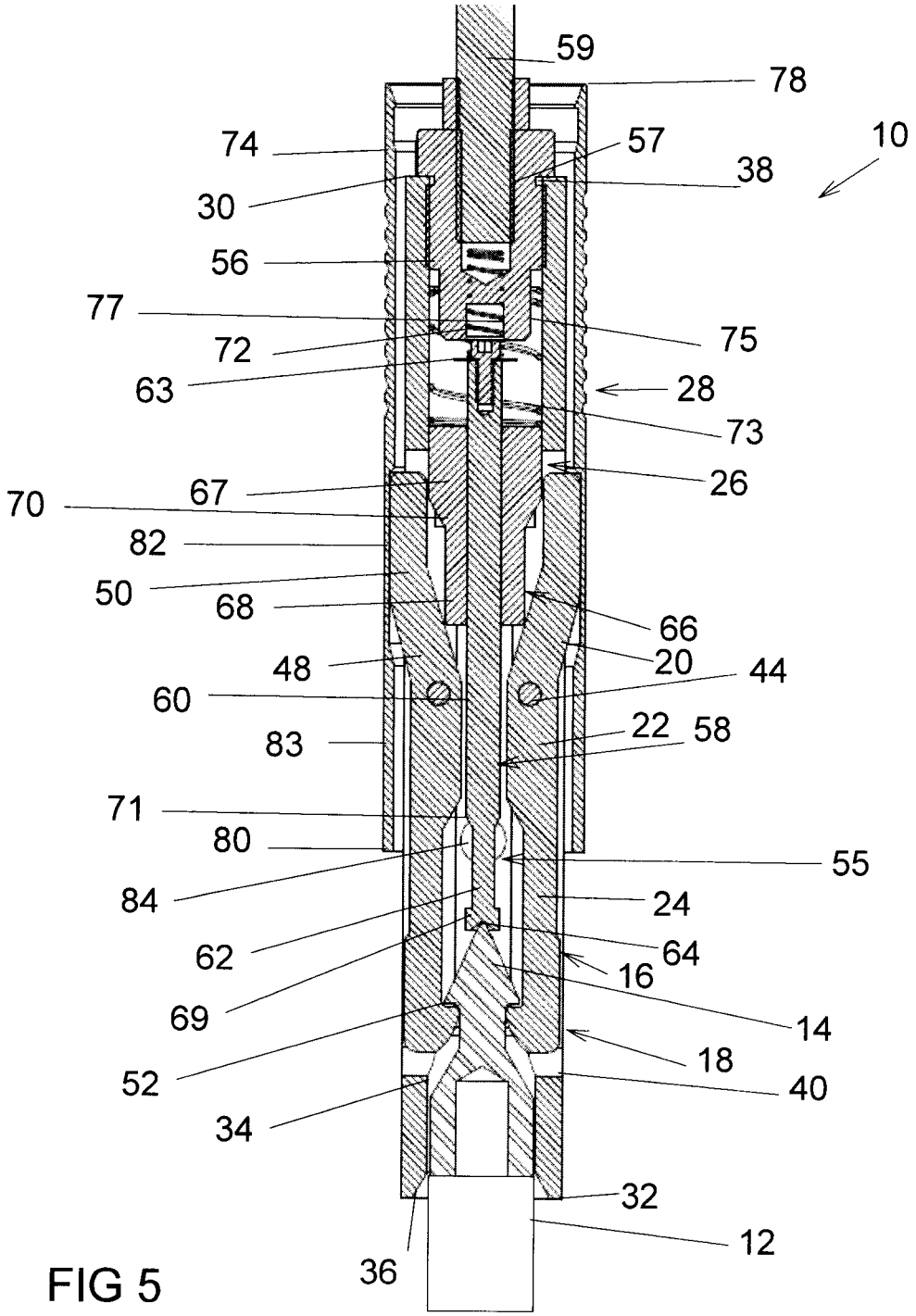
FIG. 5, in a side cross-sectional view, illustrates the overshot shown in FIGS. 1 to 4, the overshot being shown with the dog control element in the locked configuration.
Figure 7:
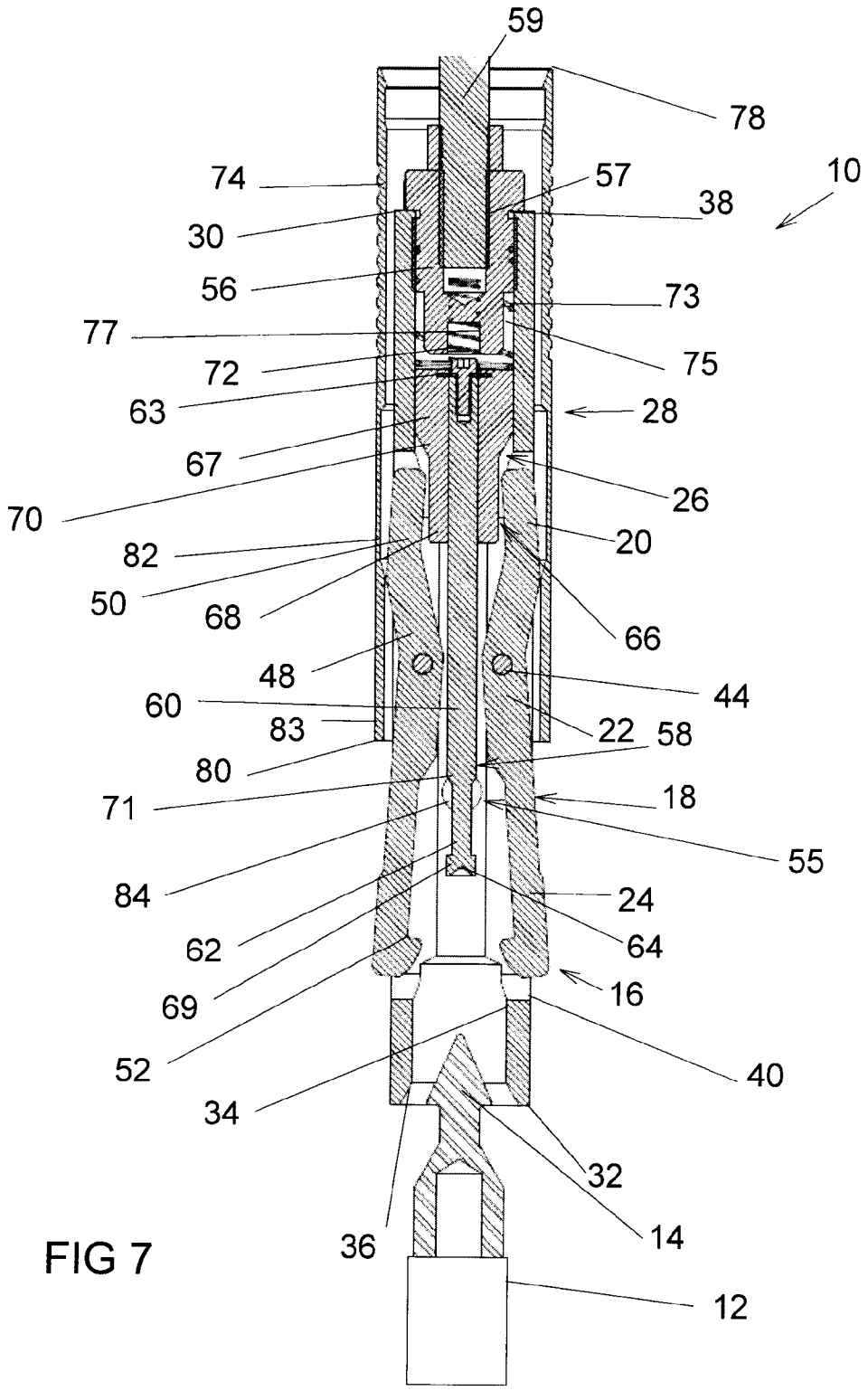
FIG. 7, in a side cross-sectional view, illustrates the overshot shown in FIGS. 1 to 6, the overshot being shown with the dog control element in the released configuration.
Figure 8:
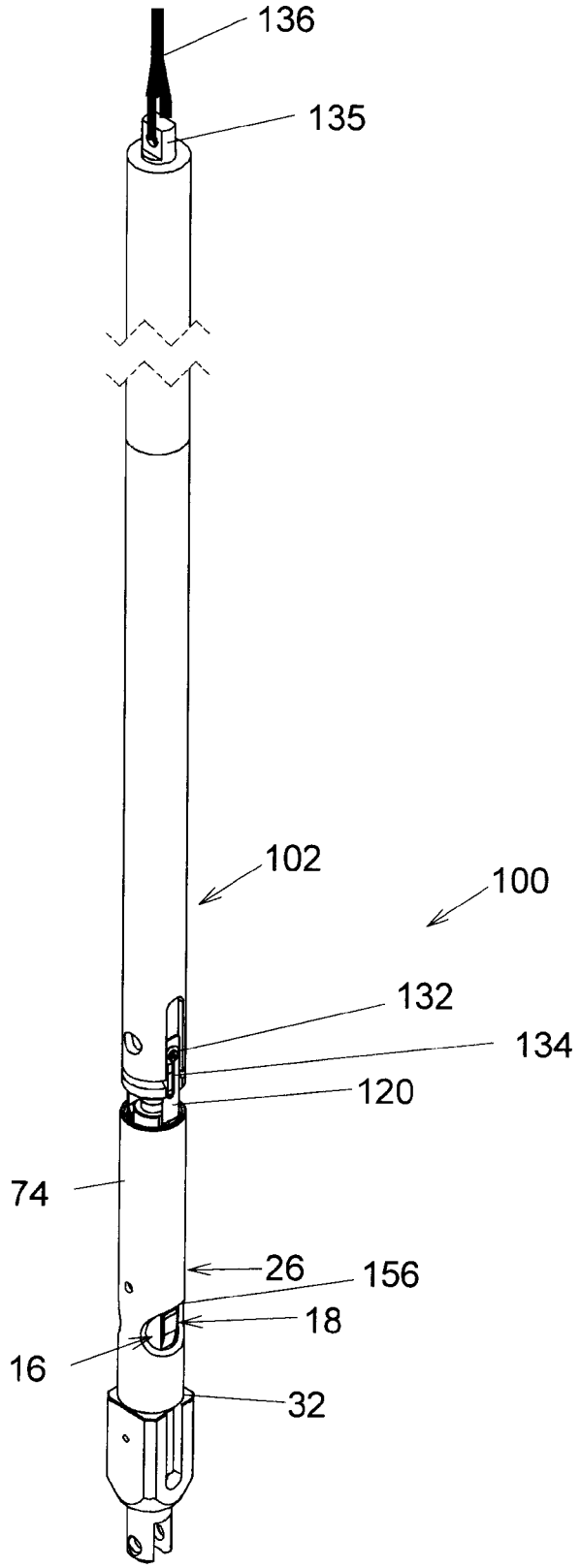
FIG. 8, in a perspective view, illustrates and overshot in accordance with an alternative embodiment of the present invention.

As better seen in FIGS. 3, 5 and 7, the lifting dogs 18 are substantially elongated and extend along the overshot body 16. The lifting dogs 18 define each a dog proximal section 20, a dog distal section 24 substantially opposed thereto and a dog intermediate section 22 extending therebetween. The lifting dogs 18 are pivotally mounted to the overshot body 16 in the dog intermediate section 22 so as to be movable between a dog closed configuration, seen for example in FIG. 3, and a dog open configuration, seen for example in FIG. 7. The dog distal sections 24 are configured and sized for allowing latching of the spearhead point 14 therebetween when the lifting dogs 18 are in the dog closed configuration. The dog distal sections 24 are spread apart from each other to a greater extent in the dog open configuration than in the dog closed configuration for allowing substantially free movements of the spearhead point 14 therebetween.

Figure 2:
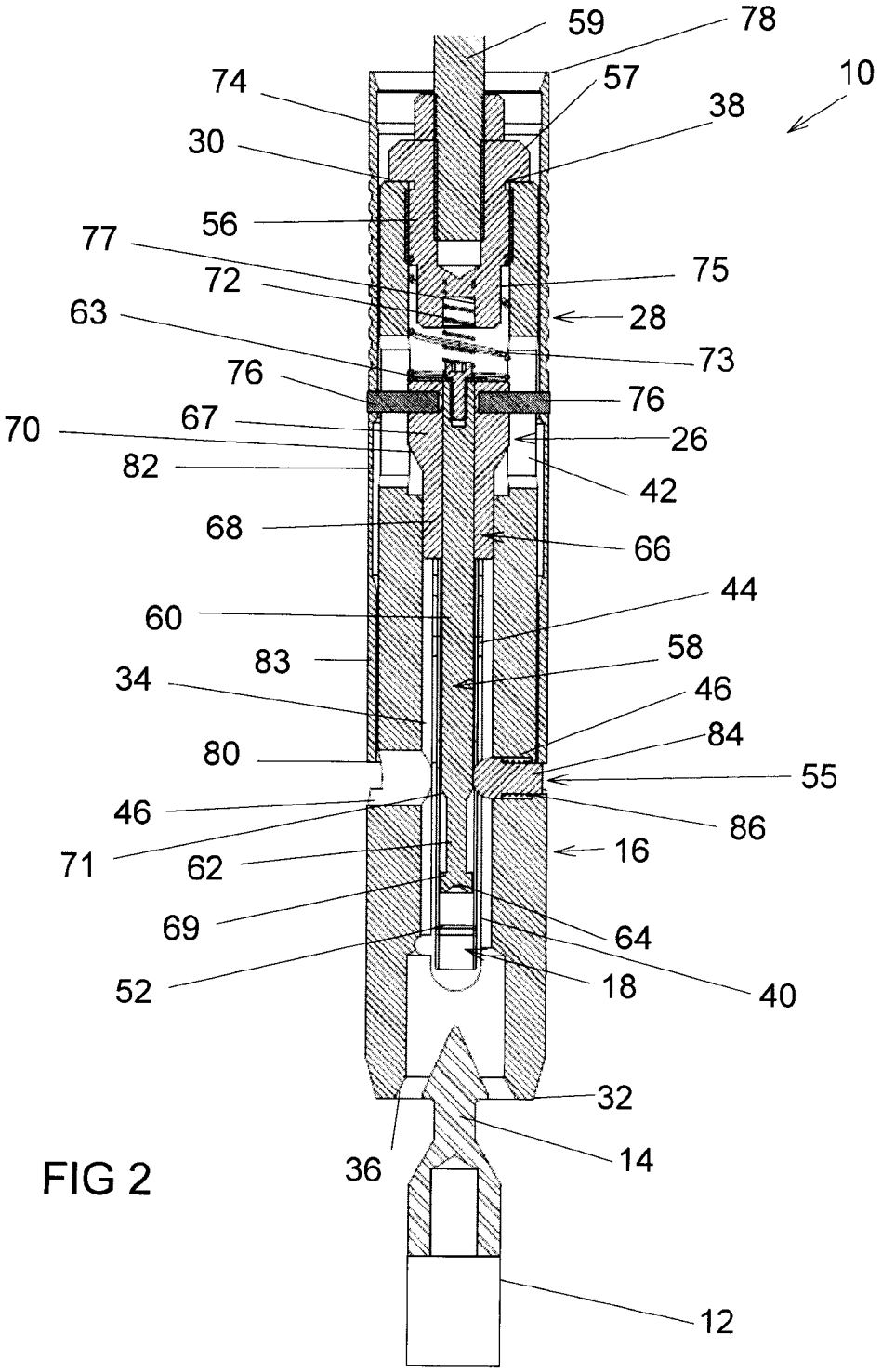
FIG. 2, in a front cross-sectional view, illustrates the overshot shown in FIG. 1, the overshot being shown with a dog control element thereof in an armed configuration.
Figure 4:
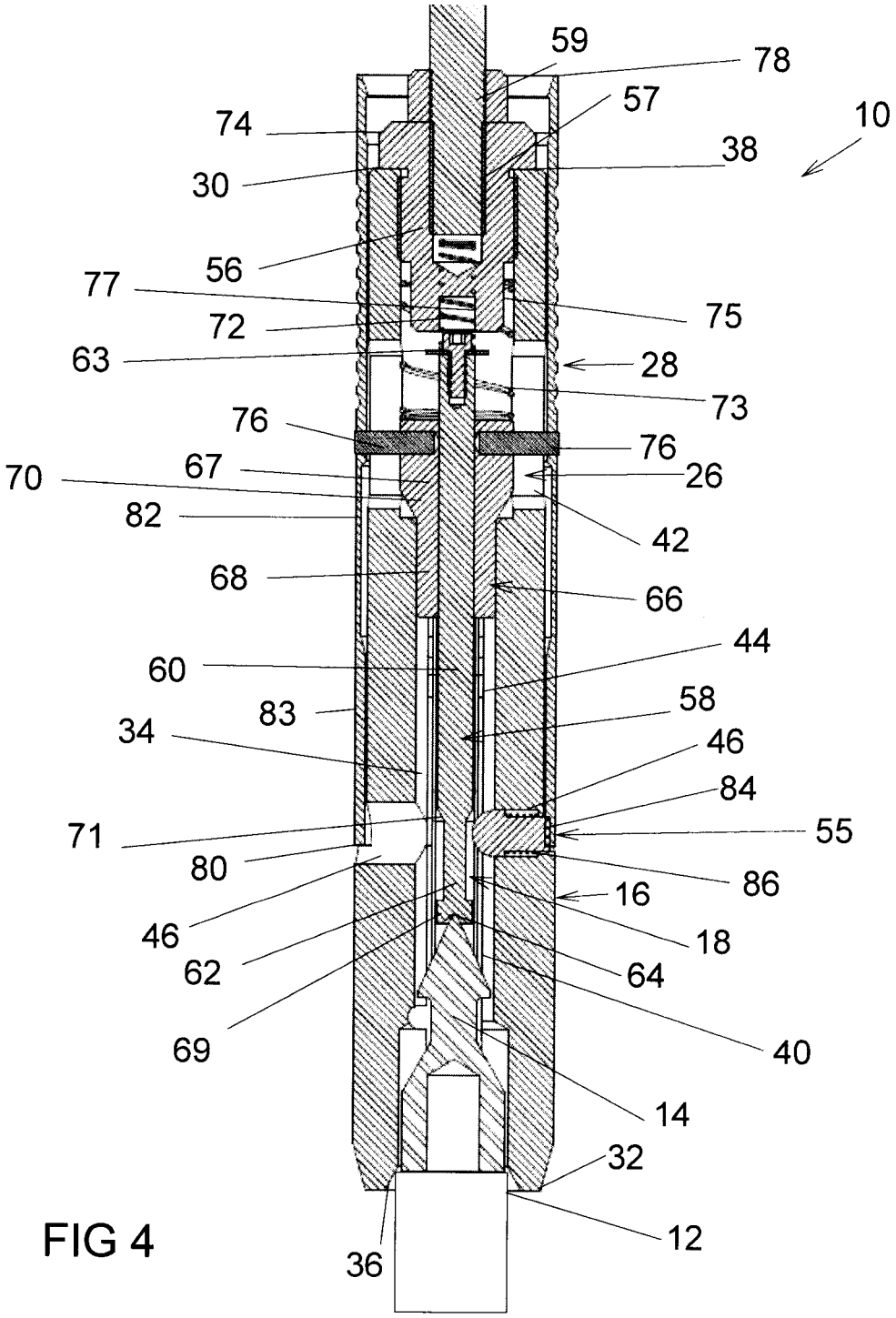
FIG. 4, in a front cross-sectional view, illustrates the overshot shown in FIGS. 1 to 3, the overshot being shown with the dog control element in a locked configuration.
Figure 6:
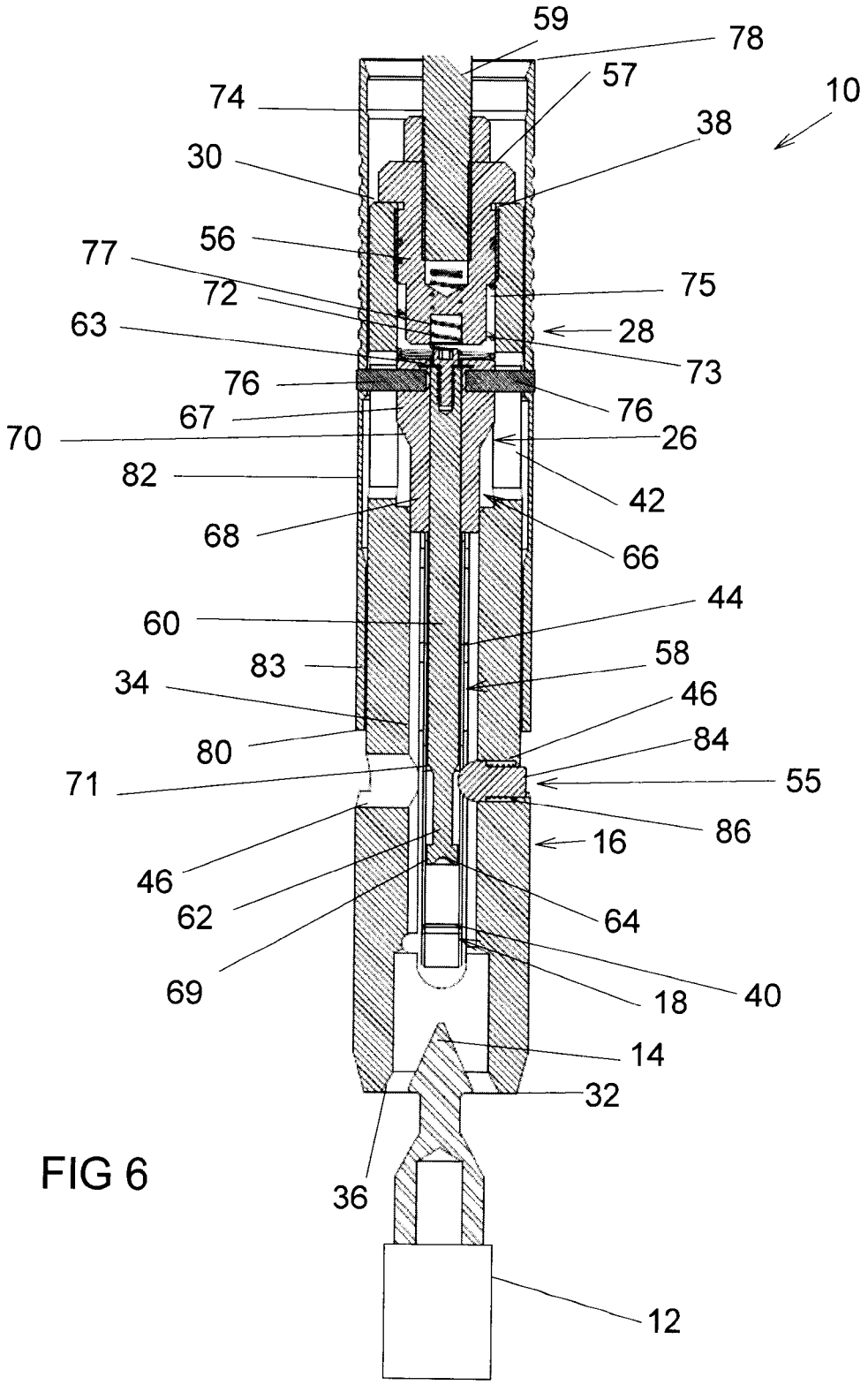
FIG. 6, in a front cross-sectional view, illustrates the overshot shown in FIGS. 1 to 5, the overshot being shown with the dog control element in a released configuration.

The dog control element 26 is operable between an armed configuration, seen in FIGS. 2 and 3, a locked configuration, seen in FIGS. 4 and 5, and a released configuration, seen in FIGS. 6 and 7. In the armed configuration, the lifting dogs 18 are movable between the dog closed and open configurations for allowing insertion of the spearhead point 14 therebetween. In the locked configuration, the lifting dogs 18 are locked in the dog closed configuration. In the released configuration, the lifting dogs 18 are positioned in the dog open configuration.

The dog control element 26 is typically automatically configured from the armed configuration to the locked configuration when the spearhead point 14 is latched between the dog distal sections 24 with the dog control element 26 in the armed configuration. Also typically, the dog control element 26 automatically achieves the armed configuration when the dog control element 26 is moved to the released configuration and is subsequently released.

For the purpose of this document, the terminology proximal and distal refers to a distance from an operator located on the surface who operates the overshot 10 down a bore hole. Therefore, distal elements are provided lower in the bore hole, or further away from the operator, than proximal elements. This terminology is used to facilitate the description of the overshot 10 and should not be used to restrict the scope of the present invention. Also, the terminology "substantially" is used to denote variations in the thus qualified terms that have no significant effect on the principle of operation of the overshot 10. These variations may be minor variations in design or variations due to mechanical tolerances in manufacturing and use of the overshot 10. These variations are to be seen with the eye of the reader skilled in the art.

The overshot body 16 is substantially elongated. The overshot body 16 defines a body proximal end 30 and a substantially opposed body distal end 32. A body passageway 34 extends between the body proximal and distal ends 30 and 32. A body distal aperture 36 located substantially adjacent the body distal end 32 leads into the body passageway 34. The body distal aperture 36 is typically coaxial with the body passageway 34. In some embodiments of the invention, a body proximal aperture 38 is provided at the body proximal end 30 and leads into the body passageway 34 also substantially axially.

A pair of substantially opposed dog receiving apertures 40, better seen in FIGS. 2, 4 and 6, extend substantially laterally outwardly from the body passageway 34 through the overshot body 16. The lifting dogs 18 are pivotally mounted in the dog receiving apertures 40 such that the dog distal sections 24 are movable substantially laterally through the dog receiving apertures 40. For example, pivot pins 44 extend substantially transversely across each of the dog receiving apertures 40 and through a respective one of lifting dogs 18. The lifting dogs 18 are pivotable about the pivot pins 44. In some embodiments of the invention, the pivot pins are biased such that the lifting dogs 18 are biased towards the dog closed configuration. However, in alternative embodiments of the invention, the dog control element 26 is capable of reliably moving the lifting dogs between the dog closed and open configurations when the dog control element 26 is moved between the armed, locked and released configurations without requiring this bias of the lifting dogs 18 towards the dog closed configuration.

With reference to FIGS. 2, 4 and 6, at least one and typically a pair of pin receiving apertures 46 extends substantially laterally outwardly from the body passageway 34. The pin receiving apertures 46 are typically provided in a plane that is angled at 90° with respect to the plane defined by the dog receiving apertures 40. Also, each pin receiving aperture 46 is provided longitudinally substantially in register with one of the dog receiving aperture 40. Radial apertures also extend substantially radially outwardly from the body passageway 34 through the overshot body 16. In some embodiments of the invention, the radial apertures 42 are provided in the same plane as the pin receiving aperture 46. The radial apertures 42 are provided proximally with respect to the pin receiving apertures 46.

With reference to FIGS. 3, 5 and 7, each lifting dog 18 is typically substantially elongated. The dog intermediate and distal sections 22 and 24 are substantially rectilinear and substantially collinear with each other. The dog distal section 24 is typically substantially hook shaped and defines a spearhead receiving recess 52. The spearhead receiving recesses 52 of the lifting dogs 18 face each other and are provided for receiving the spearhead point 14 therebetween. The dog proximal section 20 is substantially V-shaped and includes proximal section first and second segments 48 and 50. The proximal section first segment 48 extends from the dog intermediate section 22 and the proximal section second segment 50 extends from the proximal section first segment 48. The proximal section second segment 50 is substantially parallel to the dog intermediate and distal sections 22 and 24 and is provided at a laterally outwardly location relatively thereto. The pivot pins 44 extend through the lifting dogs 18 in the dog intermediate sections 22.

In the specific embodiment of the invention shown in the drawings, the dog control element 26 includes a control element-to-body attachment 56, an inner control element 66, an outer control element 28 and an arming element 55. The control element-to-body attachment 56 fixedly attaches the dog control element 26 to the overshot body 16. The inner and outer control elements 66 and 28 are respectively operative for selectively limiting inwardly and outwardly directed movements of the dog proximal sections 20. Typically, the inner and outer control elements 66 and 28 are jointly movable longitudinally along the overshot body 16. The arming element 55 is operative for automatically configuring the dog control element 26 from the armed configuration to the locked configuration when the spearhead point 14 is latched between the dog distal sections 24 with the dog control element 26 in the armed configuration.

The control element-to-body attachment 56 takes the form of a plug screwed into the body passageway 34 through the body proximal aperture 38. The control element-to-body attachment 56 defines an anchor 57 for anchoring the overshot 10 to a jar staff 59 or to any other suitable device allowing retrieval of the overshot 10 from a bore hole.

The inner control element 66 defines an inner control element first section 67 and an inner control element second section 68, the inner control element first and second sections 67 and 68 being substantially longitudinally offset relative to each other and provided laterally inwardly relative to the lifting dogs 18. The inner control element first section 67 is proximally located relative to the inner control element second section 68.

The inner control element first section 67 is configured and sized to prevent the lifting dogs 18 from achieving the dog open configuration when moved in register with the dog proximal sections 20. The inner control element second section 68 is configured and sized to allow the lifting dogs 18 to achieve the dog open configuration when moved in register with the dog proximal sections 20 with the inner control element first section 67 retracted from between the dog proximal sections 20. To that effect, the inner control element 66 extends laterally outwardly to a greater extent in the inner control element first section 67 than in the inner control element second section 68 in a plane including the lifting dogs 18. In some embodiments of the invention, a locking element intermediate section 70 defining an outer surface that is slanted relative to the overshot body 16 extends between the inner control element first and second sections 67 and 68 and provides a relatively smooth transition therebetween.

In some embodiments of the invention, the inner control element first and second sections 67 and 68 are substantially cylindrical so as to fit inside a substantially cylindrical body passageway 34. The inner control element first section 67 is of a larger diameter than the inner control element second section 68. The inner control element first section 67 is of a diameter substantially equal to the diameter of the body passageway 34. The locking element intermediate section 70 is substantially frusto-conical.

The outer control element 28 defines an outer control element first section and an outer control element second section 83, the outer control element first and second sections 82 and 83 being provided laterally outwardly relative to the lifting dogs 18 and longitudinally offset relative to each other. The outer control element first section 82 is configured and sized to allow the lifting dogs 18 to achieve the dog closed configuration when moved in register with the dog proximal sections 20. The outer control element second section 83 is configured and sized to force the lifting dogs 18 to achieve the dog open configuration when moved in register with the dog proximal sections 20. Typically, the outer control element first section 82 is proximally located relative to the outer control element second section 83.

In some embodiments of the invention, the outer control element 28 takes the form of a locking sleeve 74 mounted outside the overshot body 16 and substantially longitudinally movable relatively thereto. The locking sleeve 74 had a larger inner diameter in the outer control element first section 82 than in the outer control element second section 83.

As seen in FIGS. 2, 4 and 6, a pair of sleeve-to-locking element couplers 76 extend between the locking sleeve 74 and the inner control element 66 through the radial apertures 42. The sleeve-to-locking element couplers 76 ensure joint movement of the locking sleeve 74 and locking element 66. For example, the sleeve-to-locking element couplers 76 take the form of pins secured to the locking sleeve 74 and to the inner control element 66.

The locking sleeve 74 defines a sleeve proximal end 78 and a substantially opposed sleeve distal end 80. The sleeve distal end 80 is provided substantially in register with the dog receiving apertures 40. The locking sleeve 74 defines a recess extending substantially radially outwardly thereinto to define the outer control element first section 82, for example in the form of a substantially circumferential groove.

The arming element 55 is operative for selectively preventing movement of the inner and outer control elements 66 and 28 towards the body distal end 32 when the inner and outer control elements 66 and 28 are positioned proximally to a predetermined longitudinal position so as to maintain the dog control element 26 in the armed configuration. The arming element includes the trigger 58 and a locking element 84.

The trigger 58 is movable along the overshot body 16 between a trigger first position, seen for example in FIG. 2, and a trigger second position, seen for example in FIG. 4. The trigger 58 is configured and sized for moving from the trigger first position to the trigger second position when the spearhead point 14 is inserted between the lifting dogs 18. More specifically, the spearhead point 14 abuts against the trigger 58 and moves the trigger 58 towards the body proximal end 30 when the spearhead point 14 is inserted between the lifting dogs 18, the movement of the trigger 58 towards the body proximal end 30 causing the dog control element 26 to achieve the locked configuration.

The trigger 58 includes a spearhead receiving section 69 provided between the lifting dogs 18 for receiving part of the spearhead point 14, a trigger released section 62 provided proximally with respect to the spearhead receiving section 69 and a trigger engaged section 60 provided proximally with respect to the trigger released section 62. The trigger 55 extends towards the pin receiving aperture 46 to a greater extent in the trigger engaged section 60 than in the trigger released section 62. Moving the trigger 58 between the trigger first and second positions moves respectively the trigger engaged and released sections 60 and 62 in register with the pin receiving aperture 46.

In some embodiments of the invention, the trigger 58 also defines a trigger transition section 71 extending between the trigger engaged and released sections 60 and 62, the trigger transition section 71 defining a slanted surface obliquely oriented relative to the overshot body 16 and providing a smooth transition between the trigger engaged and released sections 60 and 62 to guide a pin 84 (described in greater details hereinbelow) therealong as the trigger 58 is moved between the trigger first and second positions.

The trigger engaged section 60 extends through the inner control element and protrudes therefrom both proximally and distally. The trigger engaged section 60 is cylindrical and of a larger diameter than the trigger released section 62, which is also cylindrical. A substantially radially extending flange 63 is provided substantially adjacent the proximal end of the trigger 58 and restricts movement in the distal direction of the trigger 58 with respect to the inner control element 66. The spearhead receiving section 69 also defines in some embodiments of the invention a spearhead receiving recess 64 extending longitudinally thereinto for receiving an apex of the spearhead point 14 thereinto.

The locking element 84 is movable between a locking element extended position, seen for example in FIG. 2, and a locking element retracted position, seen for example in FIG. 4. The locking element 84 is in the locking element extended position when the trigger 58 is in the trigger first position and the locking element is in the locking element retracted position when the trigger 58 is in the trigger second position.

In the locking element extended position, the locking element 84 extends across a path of travel of the outer control element 28 as the outer control element moves from an outer element proximalmost position to an outer element distalmost position. In the locking element retracted position, the locking element is retracted from the path of travel. When the trigger 58 moves from the trigger first position to the trigger second position, the locking element 84 moves from the locking element extended position to the locking element retracted position, thereby allowing distally oriented movements of the outer control element 28 beyond the predetermined longitudinal position to configure the dog control element 26 to the locked configuration.

Referring to FIGS. 2, 4 and 6, in some embodiments of the invention, two locking elements 84 are provided in the form of a pins 84 (only one of which is seen in the drawings) provided laterally outwardly with respect to the trigger released and engaged sections 62 and 60 and received in a respective pin receiving aperture 46. Each pin 84 is biased substantially laterally inwardly by a respective biasing element 86, for example a coil spring inserted in a suitably shaped pin receiving aperture 46. Each pin 84 is movable substantially laterally in the pin receiving aperture 46 between a pin extended position, seen for example in FIG. 2 and corresponding to the locking element extended position, and a pin retracted position, seen for example in FIG. 4 and corresponding to the locking element retracted position.

In the pin extended position, the pin 84 protrudes outwardly from the overshot body 16 and extends across the path of travel of the outer control element 28 to prevent the locking sleeve 74 from moving in register with the pin receiving aperture 46. In the pin retracted position, the pin 84 is positioned laterally inwardly with respect to the pin extended position and is retracted from across the path of travel of the outer control element 28, thereby allowing the locking sleeve 74 to move in register with the pin receiving aperture 46. In both the pin extended and retracted positions, the pin 84 protrudes in the body passageway 34, is biased towards the trigger 58 and abuts thereagainst. The trigger 58 extends towards the pin 84 to a greater extent in the trigger engaged section 60 than in the trigger released section 62. Moving the trigger 58 between the trigger first and second positions moves respectively the trigger engaged and released sections 60 and 62 in register with the pin 84 to move the pin respectively to the pin extended and retracted positions.

In a specific embodiment of the invention, the trigger 58 and the inner control element 66 are substantially concentric and provided in the body passageway 34. The trigger 58 extends through the inner control element 66 and is substantially longitudinally slidable relative thereto. The trigger 58 is at least in part provided between the dog distal sections 24. The trigger 58 and locking element 66 are movable substantially longitudinally along the body passageway 34 and are both biased towards a distal position. To that effect, a pair of biasing elements 72 and 73 extend between the control element-to-body attachment 56 and respectively the trigger 58 and the inner control element 66. The biasing elements 72 and 73 take for example the form of substantially concentric coil springs extending between the control element-to-body attachment 56 and one of the trigger 58 and the inner control element 66. In this example, the biasing element 73 is received at its proximal end in an annular groove 75 defined between the control element-to-body attachment 56 and the overshot body 16. Also, the biasing element 72 is received at its proximal end in a recess 77 defined longitudinally in the control element-to-body attachment 56. Since the inner and outer control elements 66 and 28 are jointly movable, both the inner and outer control elements 66 and 28 are biased towards the body distal end 32.

In a specific embodiment of the invention, the trigger 58, inner control element 66, outer control element 28 and body passageway 34 all have a generally cylindrical configuration. However, other configurations are within the scope of the invention.

The mode of operation of the overshot 10 is described in the following paragraphs. As seen with reference to FIGS. 2 and 3, in the armed configuration, the trigger 58 is in its distalmost position, the trigger first position. The pin 84 abuts against the trigger engaged section 60 and is in the pin extended position. The outer control element 28 abuts against the pin 84. The lifting dogs 18 are in the dog closed configuration and the proximal section second segments 50 are received in the outer control element first section 82. The lifting dogs 18 are free to move towards the dog open configuration because the dog proximal sections 20 are substantially in register with the inner control element second section 68, which is of a smaller diameter than the body passageway 34. The inner control element 66 is biased towards the distal location by the biasing element 73. However, the inner control element 66 is prevented from moving distally by the outer control element 28 that abuts against the pin 84. The trigger 58 is prevented from moving distally with respect to the inner control element 66 by the flange 63 that abuts against the inner control element 66.

When the spearhead point 14 is moved longitudinally through the body distal aperture 36, the spearhead point 14 spreads apart the dog distal sections 24 and the lifting dogs 18 are moved to the dog open configuration. With reference to FIGS. 4 and 5, as the spearhead point 14 is further moved proximally through the body passageway 34, the lifting dogs 18 come back to the dog closed position and the locked configuration is achieved. As the spearhead point 14 is moved through the body passageway 34, the trigger 58 is moved proximally by the spearhead point 14 to the trigger second position. In the locked configuration, the trigger 58 is in its proximalmost position and the trigger released section 62 is substantially in register with the pins 84, which are thus freed to move towards the pin retracted positions. In turn, this allows movement of the inner and outer control elements 66 and 28 towards the distal direction to a position in which the inner control element first section 67 is substantially in register with the proximal section second segments 50, which are thus prevented from moving radially inwardly inside the body passageway 34. The proximal section second segments 50 are maintained in the outer control element first section and the lifting dogs 18 are locked in the closed configuration. This allows safe retrieval of the equipment 12. The inner control element 66 is prevented from moving too far away distally in the body passageway 34 by the configuration of the dog proximal sections 20 that interfere with this movement.

With reference to FIGS. 6 and 7, to release the spearhead point 14, the locking sleeve 74 is manually retracted towards the proximal direction. This movement retracts the inner control element 66 to the inner control element second position, that is to a position wherein the inner control element second section 68 is in register with the dog proximal section 20, which allows movement of the lifting dogs 18 towards the dog open position. Simultaneously, the outer control element 28 is moved proximally until the outer control element first section becomes out of register relative to the proximal section second segments 50, or in other words until the outer control element second section 83 becomes in register with the proximal section second segments 50, at which point the dog proximal sections 20 are forced laterally inwardly inside the body passageway 34, which moves the lifting dogs 18 to the dog open configuration.

Finally, releasing the locking sleeve 74 reconfigures the overshot 10 in the armed configuration as the pins 84 have been forced to resume the pin extended position by the movement of the trigger 58 caused by the biasing element 72 when the spearhead point 14 has been removed and the inner and outer control elements have been moved distally by the biasing element 73.

FIGS. 8 to 16 illustrate an overshot 100 in accordance with an alternative embodiment of the present invention. In FIGS. 8 to 16, reference numerals that were used in the description of the overshot 10 designate components that are substantially similar in shape and function in both overshots 10 and 100. Parts designated with the letter "a" added designate parts of the overshot 100 that have a function similar to the of the part having the same number, but without the "a", in the overshot 10, but which perform this function differently. Hereinbelow, only the differences between the overshots 10 and 100 are described in details.

Figure 9:
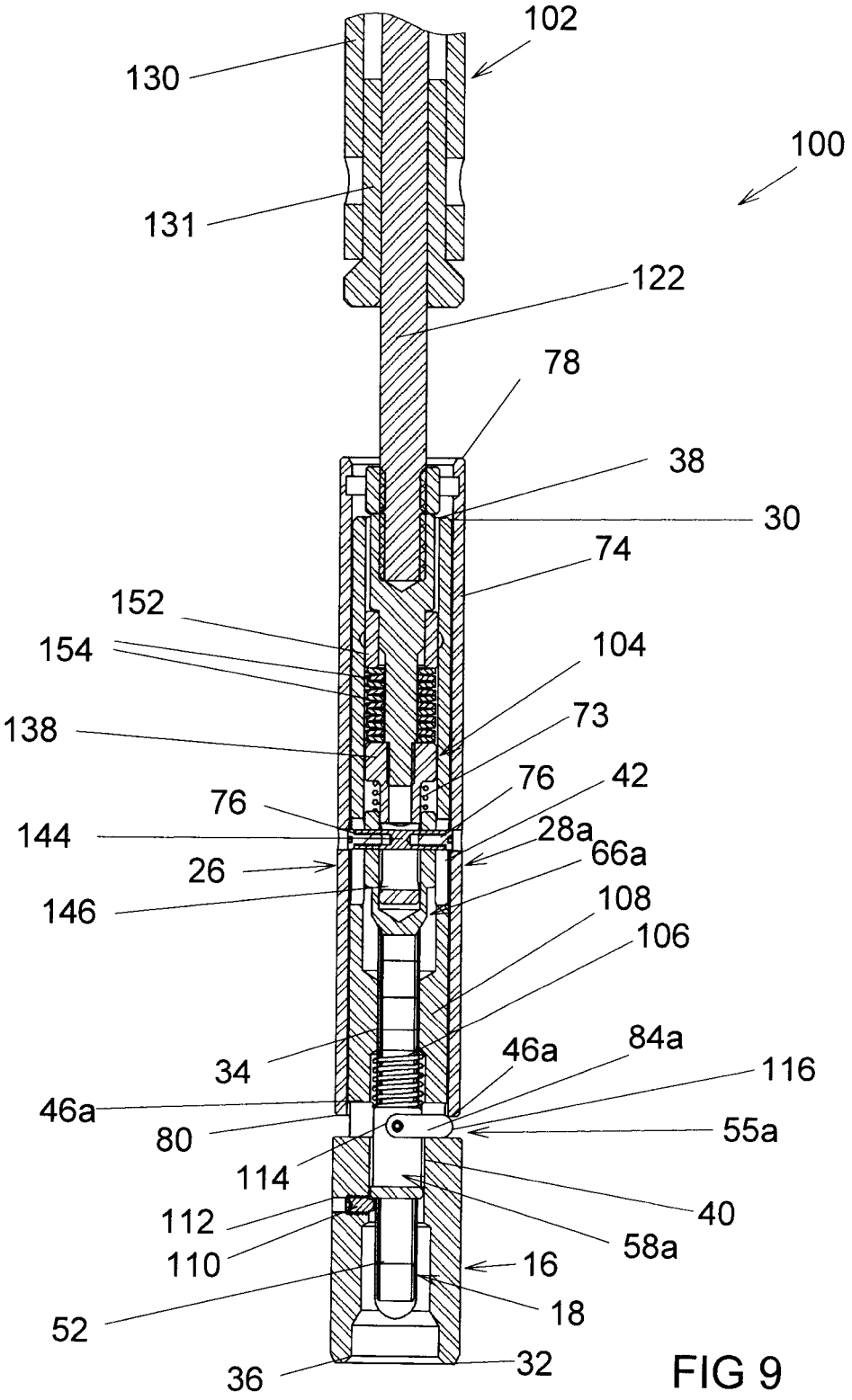
FIG. 9, in a front cross-sectional view, illustrates the overshot shown in FIG. 8, the overshot being shown with the dog control element in the armed configuration, with a remote unlocking actuator thereof in a remote actuator inactive configuration and with a safeguard control element actuator thereof in a safeguard control element deactivated configuration.

As better seen for example in FIG. 9, the overshot 100 differs from the overshot 10 by having a different arming element **55*a*. Also, the overshot 100 includes a remote unlocking actuator 102, the use of which being better shown with reference to FIGS. 13 and 14, and an overload safeguard 104, the use of which being better shown with reference to FIGS. 15 and 16**.

As seen for example in FIG. 9, the arming element **55*a* includes an alternative trigger 58*a* located entirely proximally with respect to the inner control element 66*a*, which is similar to the inner control element 66 except that the inner control element 66*a* does not define a passageway allowing the trigger 58*a* to extend therethrough, and a locking element 84*a* taking the form of at least one, an typically two, wings 84*a*, only one of which is shown in the drawings. Also, the inner control element 66*a* is completely withdrawn from between the latch dogs 18 in the armed configuration. Therefore, the inner control element 66*a* does not require two sections of different lateral dimensions. The trigger 58*a* is biased towards the trigger first position, or trigger distalmost position, for example by a coil spring 106 provided between the trigger 58*a* and a suitably configured and sized flange 108 defined by the overshot body 16 and extending in the body passageway 34. A stopper 110 also extends into the body passageway 34 and limits distally directed movements of the trigger 58*a*. In some embodiments of the invention, the stopper 110 takes the form of a screw screwed in a laterally extending threaded stopper aperture 112 extending through the overshot body 16. In these embodiments, the stopper 110 is removable to allow assembly and disassembly of the arming element 55*a***.

Figure 11:
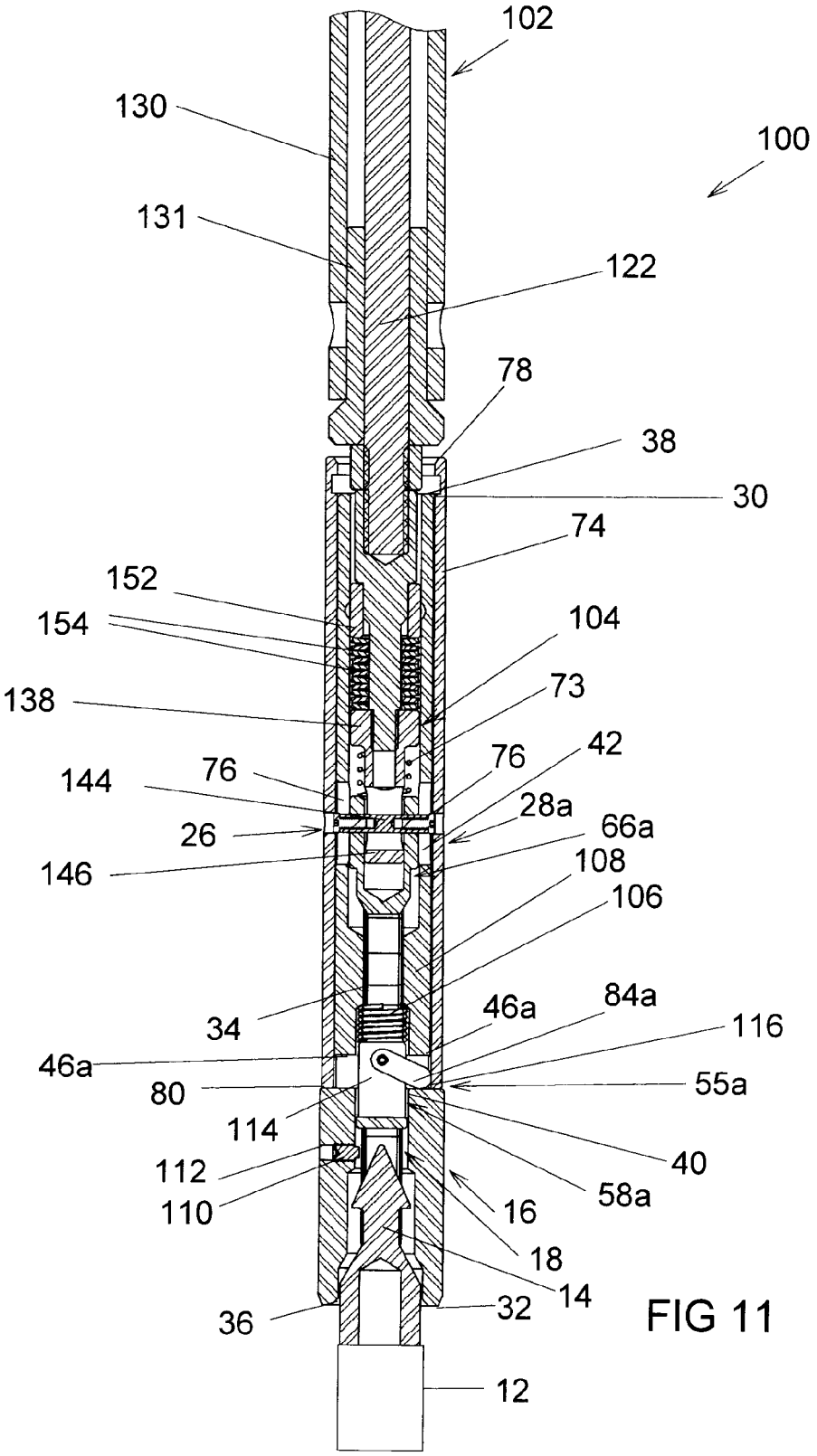
FIG. 11, in a front cross-sectional view, illustrates the overshot shown in FIGS. 8 to 10, the overshot being shown with the dog control element in the locked configuration, with the remote unlocking actuator thereof in the remote actuator inactive configuration and with the safeguard control element actuator in the safeguard control element deactivated configuration.
Figure 12:
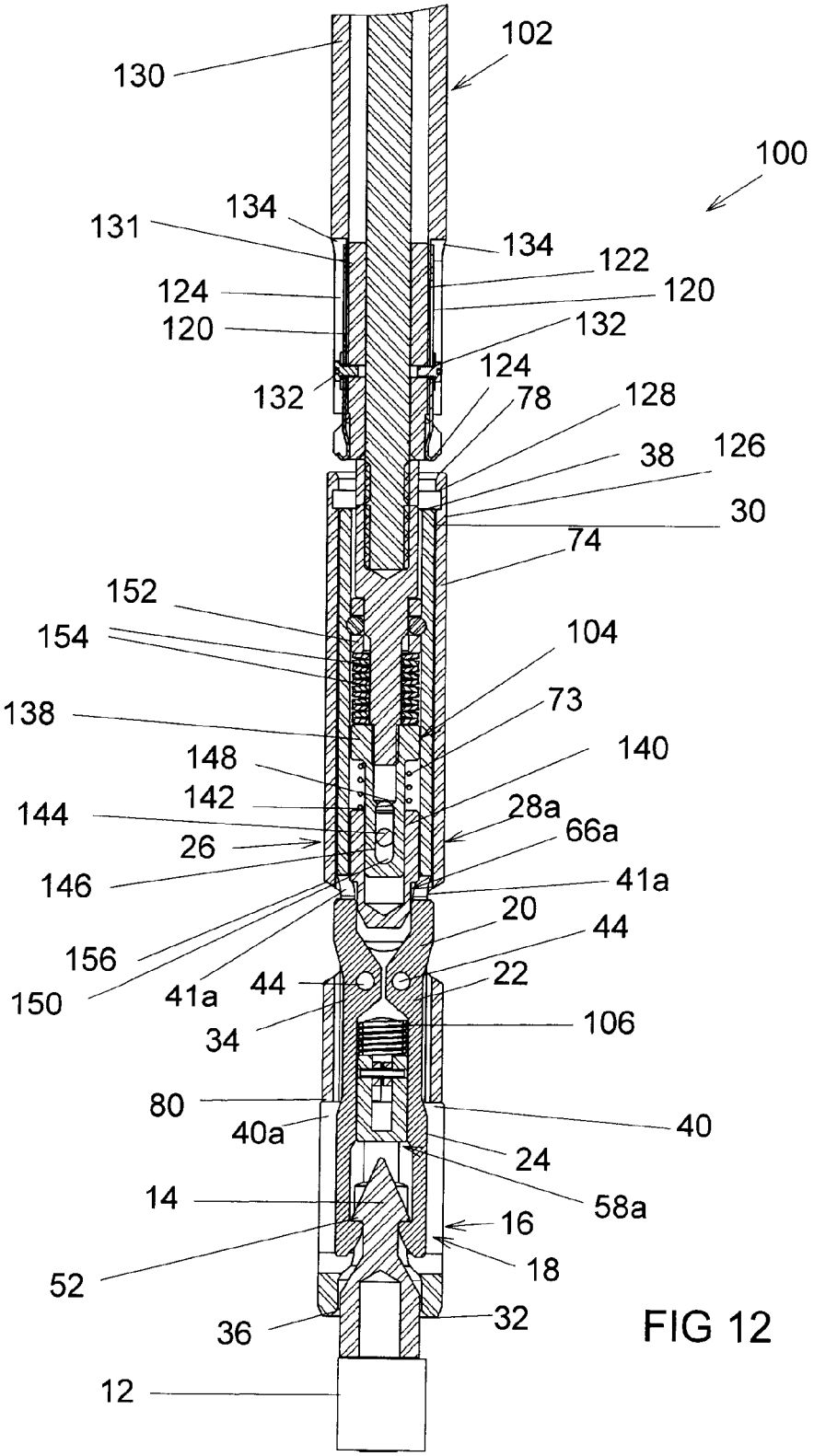
FIG. 12, in a side cross-sectional view, illustrates the overshot shown in FIGS. 8 to 11, the overshot being shown with the dog control element in the locked configuration, with the remote unlocking actuator thereof in the remote actuator inactive configuration and with the safeguard control element actuator in the safeguard control element deactivated configuration.

Each wing **84*a*, only one of which is seen in FIG. 9, defines a wing proximal end 114 and a substantially opposed wing distal end 116, the wing 84*a* being pivotally mounted to the trigger 58*a* substantially adjacent the wing proximal end so as to pivot in a plane perpendicular to the one in which the lifting dogs 18 pivot. The overshot body 16 defines a pair of wing receiving passageways 46*a* extending laterally therethrough, each wing 84*a* being mounted in a respective wing receiving passageway 46*a*. The wing distal end 116 protrudes from the wing receiving passageway 46*a* when the trigger 58*a* is in the trigger first position, as seen in FIG. 9 for example, and the wing distal end 116 is retracted in the wing receiving passageway 46*a* when the trigger 58*a* is in the trigger second position, as seen in FIG. 11 for example. In other words, as the trigger 58*a* moves in a proximal direction, the wings 84*a* are retracted into the wing receiving passageways 46*a*, which allows the outer control element 28 to move in a distal direction past the wing receiving passageways 46*a*, in a manner similar to the manner in which the arming element 55** allows a similar movement.

Figure 13:
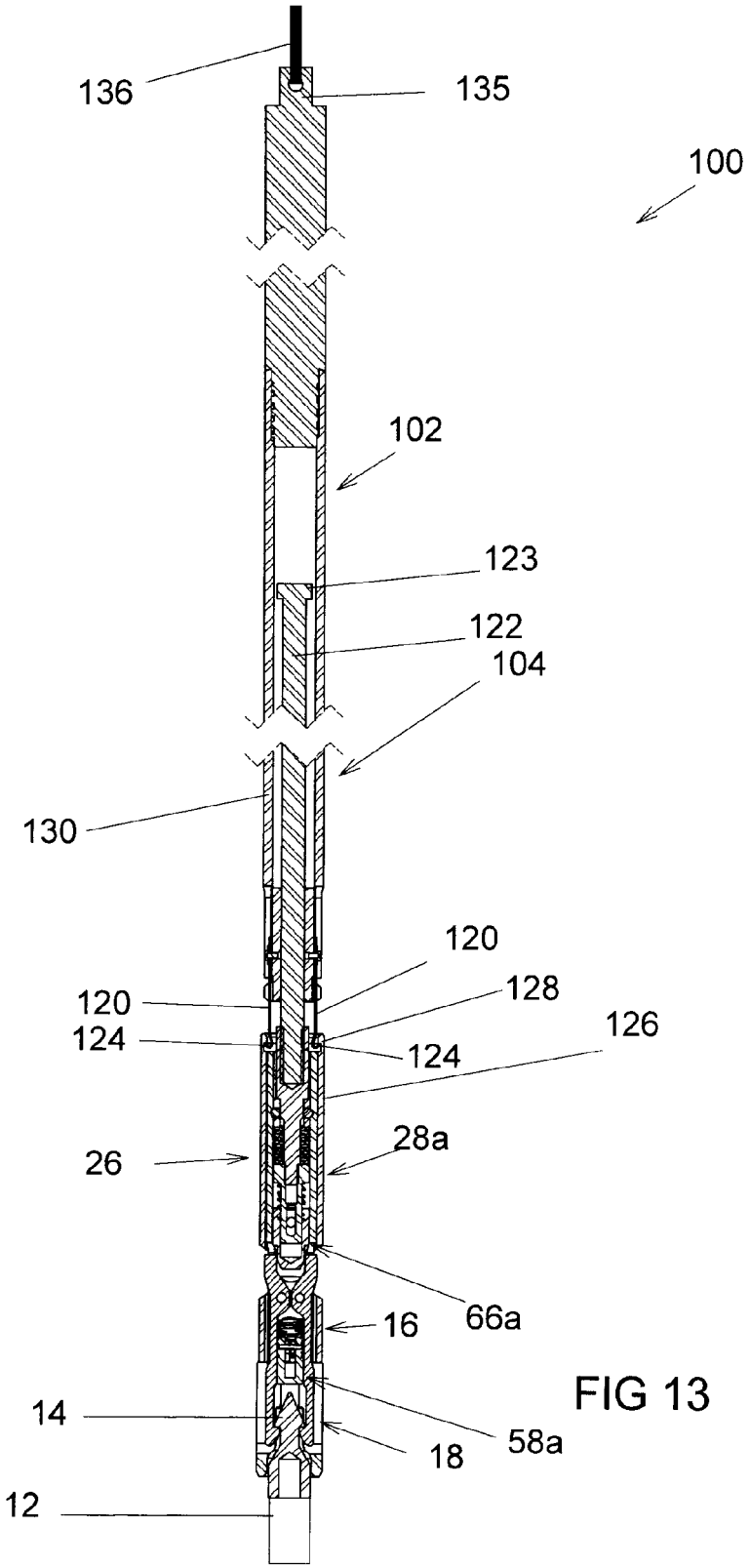
FIG. 13, in a side cross-sectional view, illustrates the overshot shown in FIGS. 8 to 12, the overshot being shown with the dog control element in the locked configuration, with the remote unlocking actuator thereof in a remote actuator active configuration and with the safeguard control element actuator in the safeguard control element deactivated configuration.
Figure 14:
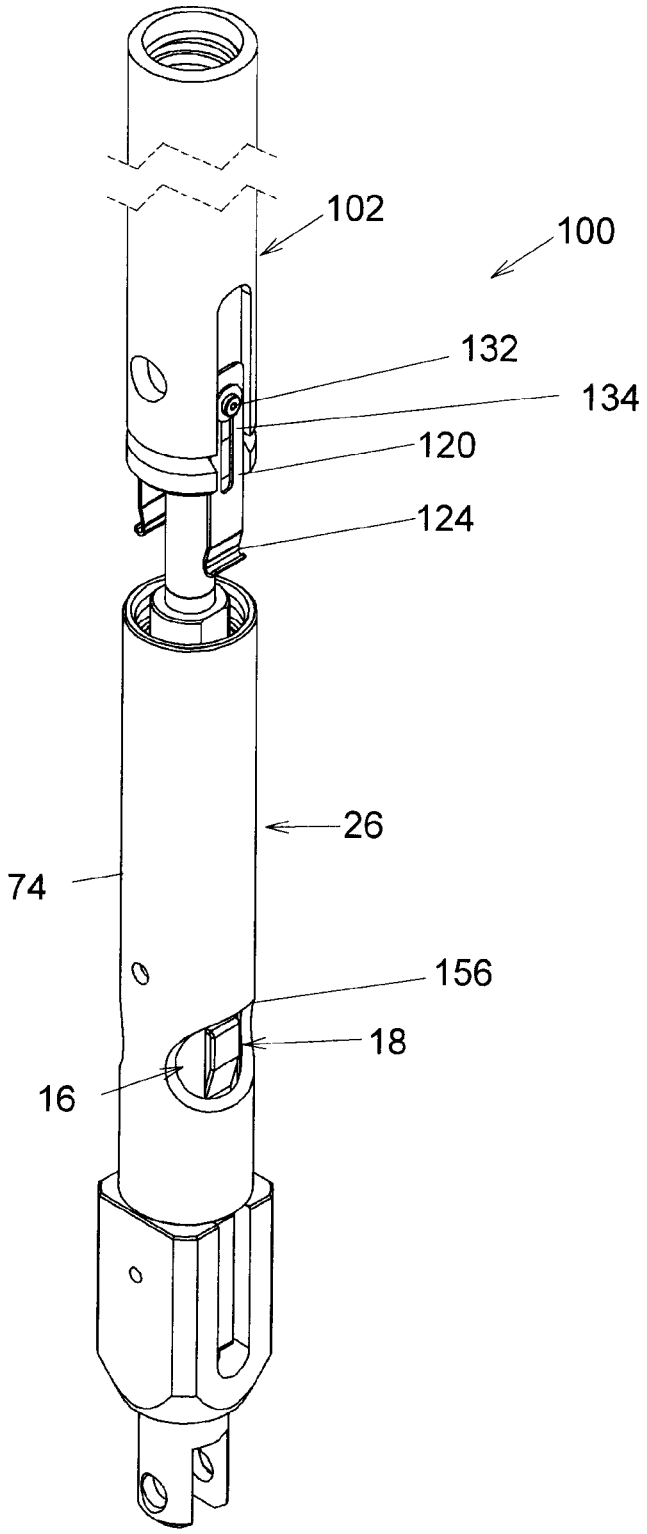
FIG. 14, in a perspective view, illustrates the overshot shown in FIGS. 8 to 13, the overshot being shown with the dog control element in the locked configuration, with the remote unlocking actuator thereof in the remote actuator active configuration and with the safeguard control element actuator in the safeguard control element deactivated configuration.
Figure 15:
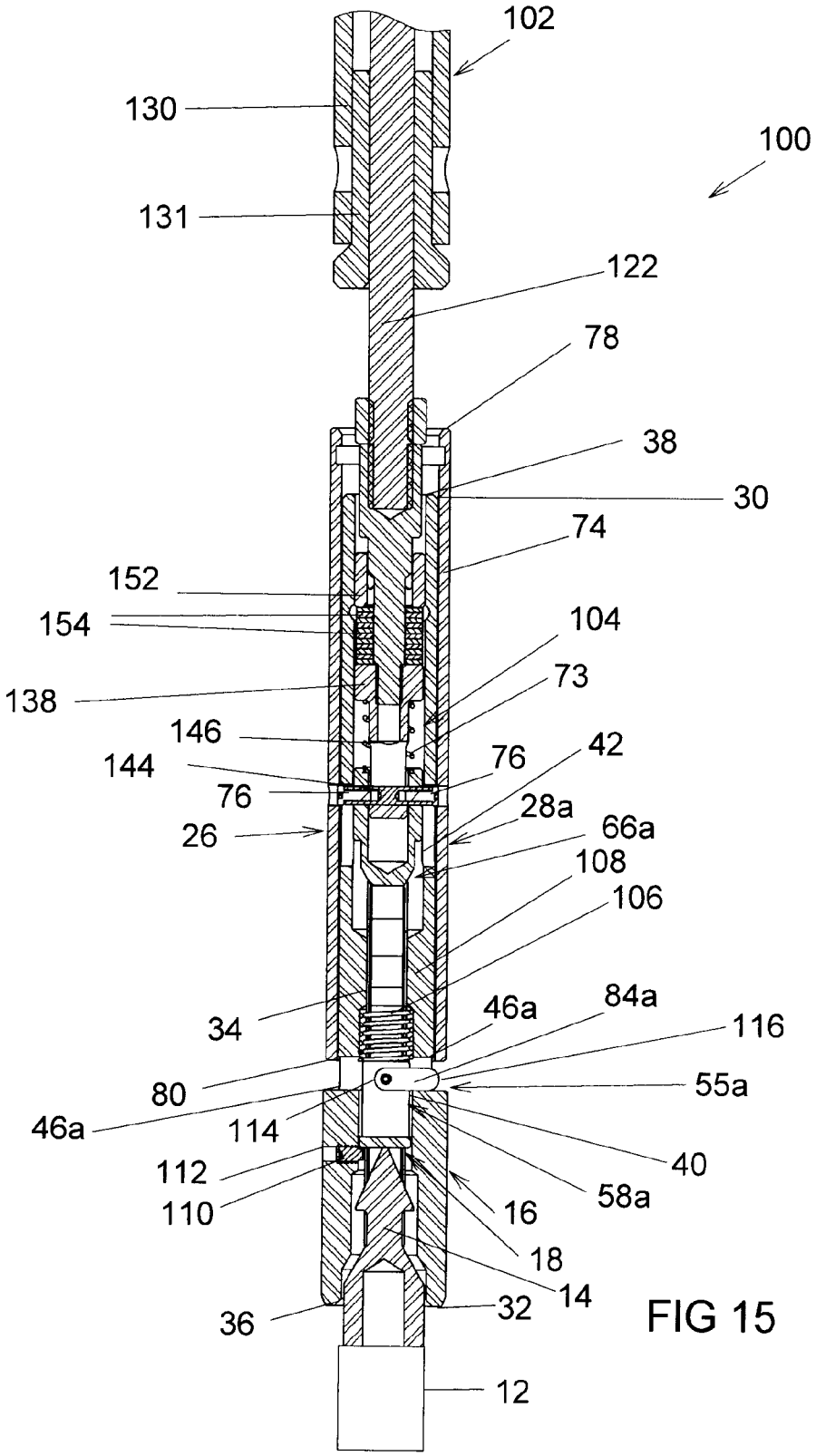
FIG. 15, in front elevation view, illustrates the overshot shown in FIGS. 8 to 14, the overshot being shown with the dog control element in the released configuration, with the remote unlocking actuator thereof in the remote actuator inactive configuration and with the safeguard control element actuator in a safeguard control element activated configuration.

Referring to FIGS. 13 and 14, the remote unlocking actuator 102 is usable for selectively moving the dog control element 26 from the locked configuration to the released configuration. This is for example useful if the overshot 100 is used to lower the equipment 12 in a bore hole (not shown in the drawings) to control the speed of descent in the bore hole, as detailed in further details hereinbelow.

Typically, the remote unlocking actuator 102 is configurable in a remote actuator active configuration, seen in FIG. 13, and in a remote actuator inactive configuration, seen in FIG. 14. In the remote actuator active configuration, the remote unlocking actuator 102 is operable to selectively move the dog control element 26 from the locked configuration to the released configuration. In the remote actuator inactive configuration, the remote unlocking actuator 102 is inoperable to selectively move the dog control element 26 from the locked configuration to the released configuration.

In a typical embodiment of the invention, the remote unlocking actuator 102 is provided proximally relative to the outer control element 28 and includes an outer control element coupler 120 for coupling the remote unlocking actuator 102 and the outer control element 28 to each other so that the remote unlocking actuator 102 and the outer control element 28 are jointly movable, as seen in FIG. 13.

The remote unlocking actuator 102 is movable longitudinally relative to the overshot body 16 between an unlocking actuator disengaged position, seen in FIG. 14, and an unlocking actuator engaged position, seen in FIG. 13. In the unlocking actuator disengaged position, the remote unlocking actuator 102 and the outer control element **28*a* are movable independently from each other. With the remote unlocking actuator 102 in the remote actuator active configuration, in the unlocking actuator engaged position, the outer control element coupler 120 is coupled to the outer control element 28*a* so that the remote unlocking actuator 102 and the outer control element 28*a*** are movable jointly. The unlocking actuator engaged position is distally located relative to the unlocking actuator disengaged position.

In a specific embodiment of the invention, the overshot body 16 includes a longitudinally extending shaft 122 provided proximally to the outer control element **28*a*, the remote unlocking actuator 102 being mounted to the shaft 122 so as to be longitudinally movable therealong. More specifically, the remote unlocking actuator 102 includes a remote unlocking actuator body 130, for example of a generally tubular shape mounted to the shaft 122 so as to be longitudinally movable therealong. The remote unlocking actuator 102 also includes a proximal attachment 135, for example provided at the proximal end of the remote unlocking actuator body 130, for attaching a cable 136 thereto. The shaft 122 defines a laterally outwardly extending shaft proximal flange 123 and the remote unlocking actuator body 130 defines a guiding section 131 for guiding the remote unlocking actuator body 130 along the shaft 122. The guiding section 131 is at the proximal end of the remote unlocking actuator body 130 and has a configuration and dimensions such that the guiding section 131 is snuggly fitted to the shaft 122, but able to slide therealong. The shaft proximal flange 123 limits movements of the unlocking actuator body 130** in a proximal direction.

The outer control element coupler 120 includes a hook 124 attachable to the outer control element **28*a*. Also, as mentioned hereinabove the outer control element 28*a* includes the locking sleeve 74, which defines a sleeve outer wall 126 and a sleeve flange 128 extending radially inwardly from the sleeve outer wall 126, the hook 124 being hookable to the sleeve flange 128. For example, the sleeve flange 128 is defined by an annular groove extending radially outwardly in the sleeve outer wall 126 from inside the sleeve outer wall 126 and substantially adjacent the sleeve proximal end 78**.

The hook 124 is mounted to the remote unlocking actuator body 130 and positionable relative thereto between a hook active position, seen in FIG. 13, and a hook inactive position, seen in FIG. 14. in the hook active position, the remote unlocking actuator 102 is in the remote actuator active configuration, and in the hook inactive position, the remote unlocking actuator 102 is in the remote actuator inactive configuration. For example, the hook 124, along with the remainder of the outer control element coupler 120, is movable longitudinally relative to the remote unlocking actuator body 130 between a proximalmost position, in which the hook is in the hook active position, and a distalmost position, in which the hook 124 is in the a hook active position. Referring to FIG. 14, a fastener 132, such as a screw or a bolt, among other possibilities, extends through the outer control element coupler 120 in a longitudinally elongated slot 134 formed thereinto and is fastened to the unlocking actuator body 130. The fastener 132 is usable to selectively lock the hook 124 in the hook active and inactive positions.

In the hook active position, the hook 124 is movable between a hook retracted position wherein the hook 124 is substantially movable longitudinally relative to the sleeve flange 128 when adjacent thereto and a hook extended position wherein the hook 124 is hookable to the sleeve flange 128 when positioned inside the locking sleeve 74 distally relative to the sleeve flange 128. For example, the outer control element coupler 120 is substantially elongated and plate-shaped and protrudes longitudinally from the remote unlocking actuator body 130 towards the locking sleeve 74 and the hook 124 is defined at a distal end thereof and opens laterally outwardly. A resilient deformation of the outer control element coupler 120 moves the hook 124 between the hook extended and retracted positions. This movement occurs laterally.

In use, the overshot 100 is usable in two different manners, depending on the configuration of the outer control element coupler 120. With the hook 124 in the hook inactive position, the overshot 100 is usable similarly to the overshot 10 for recovering a equipment 12. While movements of the remote unlocking actuator body 130 along the shaft 122 are possible as the spearhead point 14 is engaged, the hooks 124 will not affect the dog control element 26. With the hook 124 in the hook active position, the overshot 100 is usable to deliver the equipment 12 at the bottom of a bore hole as follows.

First, outside of the bore hole, the dog control element 26 is configured to the armed configuration and the spearhead point 14 is inserted between the lifting dogs 18, which configures the dog control element 26 to the locked configuration, as in the overshot 10. Then, the overshot 100 is suspended from the remote unlocking actuator body 130 using the cable 136, which moves the remote unlocking actuator to the unlocking actuator disengaged position, and the overshot 100, along with the equipment 12, is lowered in the bore hole.

When the equipment 12 reaches the bottom of the bore hole, the overshot 100 stops moving and, by continuing the feeding of the cable 136 in the bore hole, the remote unlocking actuator body 130 moves distally so that the remote unlocking actuator 102 moves to the unlocking actuator engaged position. During this movement, the hook 124 starts in the hook extended position. When the hook 124 gets in register with the sleeve flange 128, the hook 124 is automatically deflected to the hook retracted position. After the hook 124 has been moved distally past the sleeve flange 128, the hook 124 resumes the hook extended position.

Subsequently, pulling on the cable moves the remote unlocking actuator body 130 proximally and the hook 124 gets hooked to the sleeve flange 128 and pulls on the outer control element 28*a* with the remainder of the overshot 16 remaining fixed because of the combined weight of the overshot 16 and equipment 12. Once the outer control element 28*a* has been moved to a suitable extent, the dog control element 26 achieves the released configuration, and the spearhead point 14 is released from between the lifting dogs 18, which allows removal of the overshot 100 from the bore hole.

Figure 16:
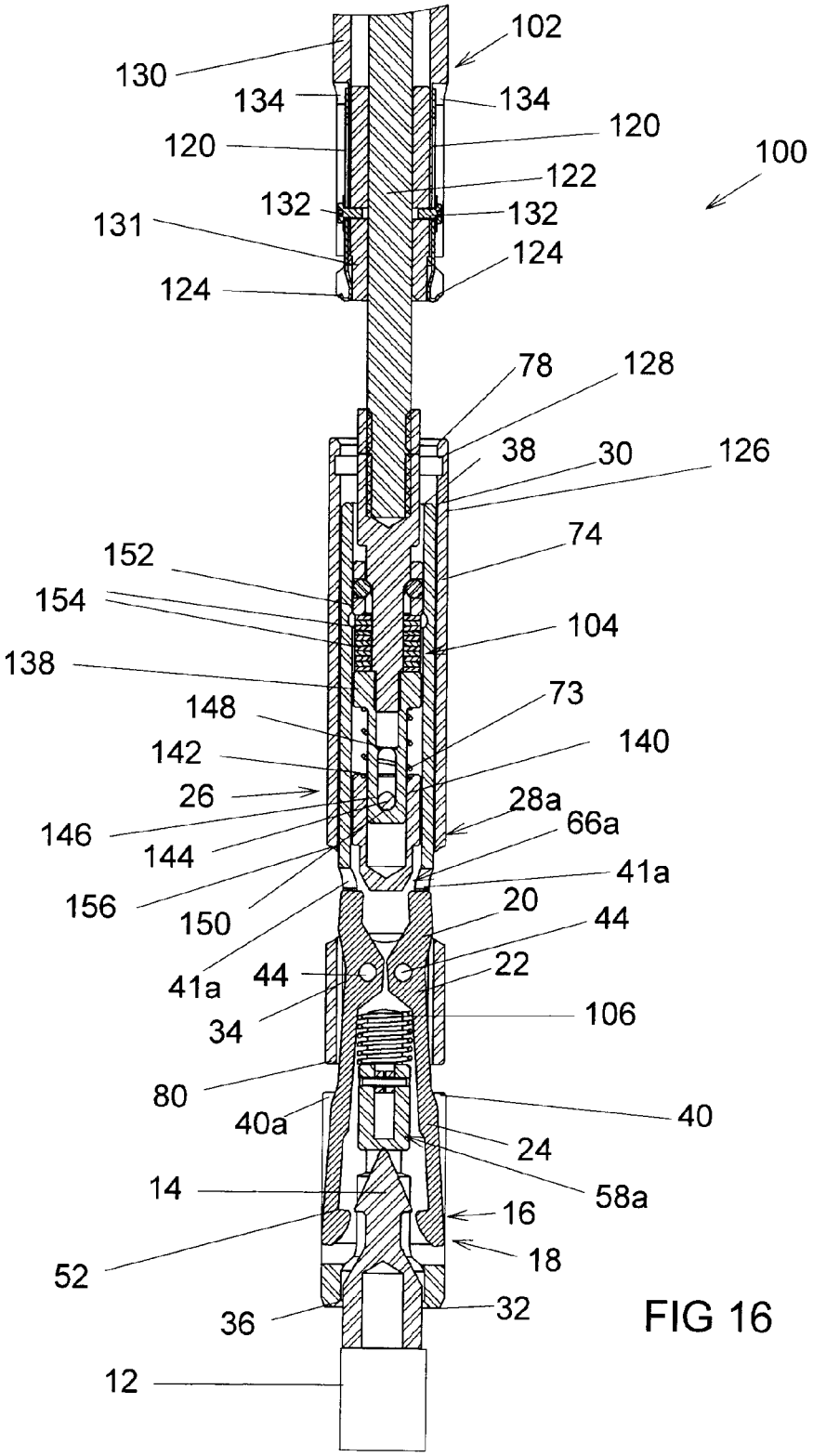
FIG. 16, in a side elevation view, illustrates the overshot shown in FIGS. 8 to 15, the overshot being shown with the dog control element in the released configuration, with the remote unlocking actuator thereof in the remote actuator inactive configuration and with the safeguard control element actuator in the safeguard control element activated configuration.
Figure 17:
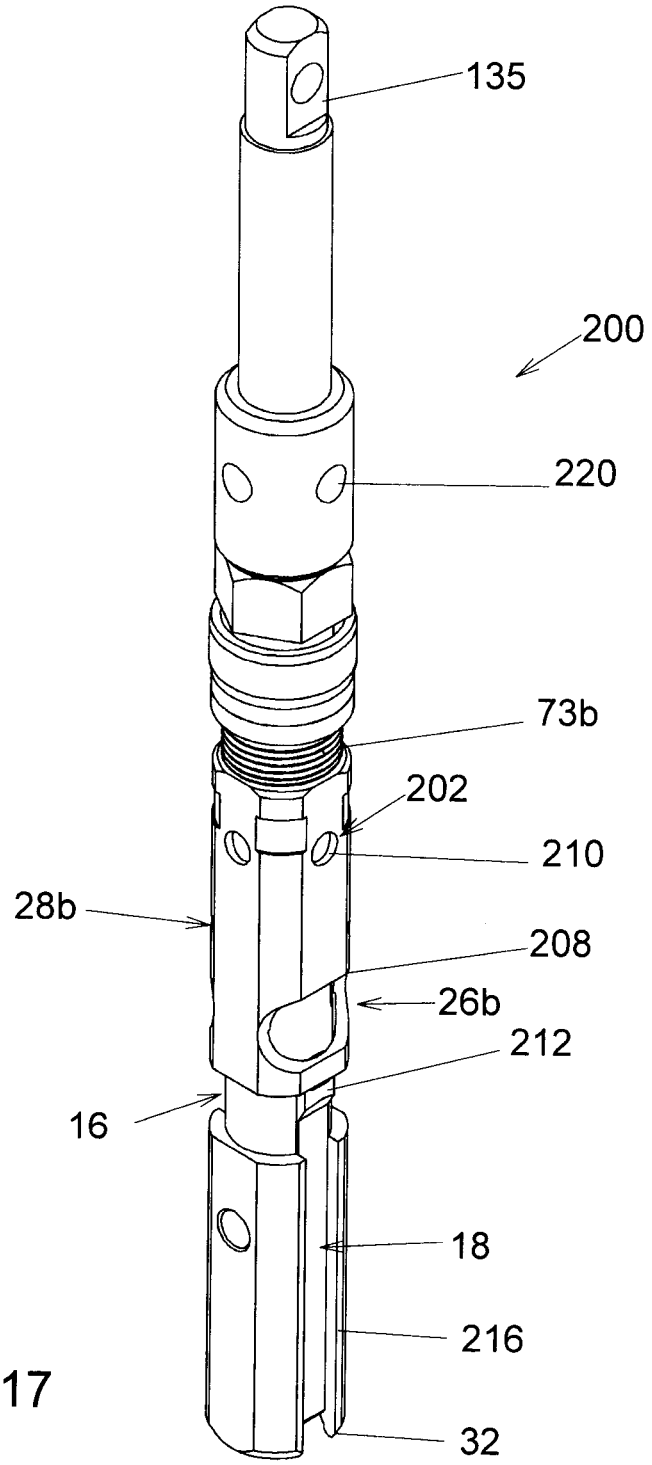
FIG. 17, in a perspective view, illustrates and overshot in accordance with another alternative embodiment of the present invention.
Figure 18:
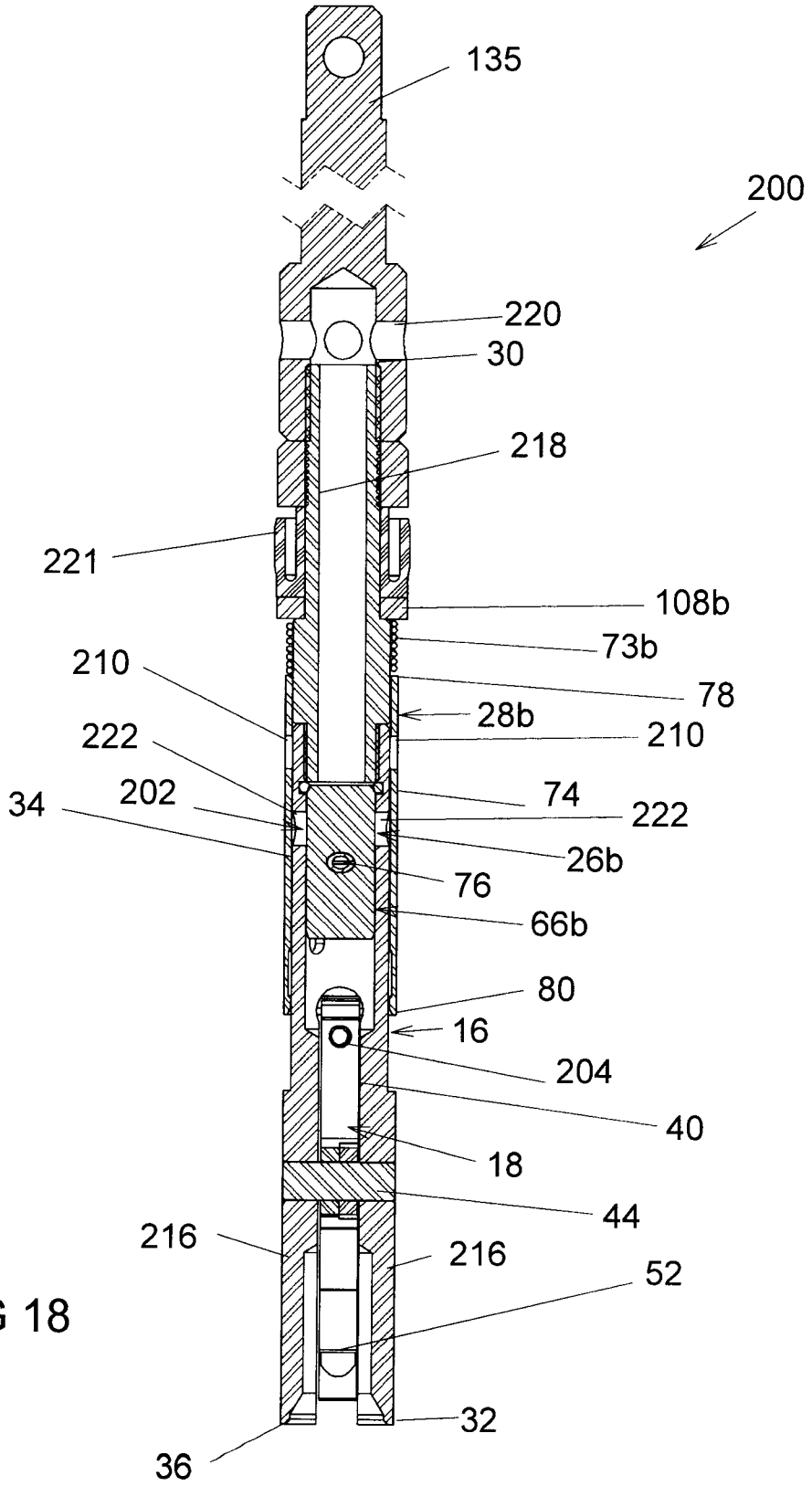
FIG. 18, in a front cross-sectional view, illustrates the overshot shown in FIG. 17, the overshot being shown with the dog control element in the armed configuration.

Referring for example to FIG. 16, the overload safeguard 104 is operatively coupled to the proximal attachment 104 and to the dog control element 26 for automatically configuring the dog control element 26 from the locked configuration to the released configuration when a proximally oriented force larger than a predetermined overload force is exerted on the proximal attachment 135 by the cable 136 (both not seen in FIG. 16).

The overload safeguard 104 includes a safeguard control element actuator 138 operatively coupled to the dog control element 26 to move the dog control element 26 to the released configuration when the distally oriented force of the predetermined overload magnitude is exerted on the proximal attachment 135. The safeguard control element actuator 138 is movable between a safeguard control element deactivated configuration (seen in FIGS. 8 to 14), and a safeguard control element activated configuration, seen in FIGS. 15 and 16). In the safeguard control element deactivated configuration, the dog control element 26 if free to move between the armed and locked configurations, and, in the safeguard control element activated configuration, the dog control element 26 is forced to achieve the released configuration. The presence of the safeguard control element actuator 138 makes unnecessary the control element-to-body attachment 56 and the biasing element 73 biasing the inner control element 66*a* extends between the safeguard control element actuator 138 and the inner control element 66*a*.

The safeguard control element actuator 138 is movable longitudinally relative to the overshot body 16 and is typically provided in the body passageway 34. The safeguard control element actuator 138 is movable longitudinally relative to the overshot body 16 and mechanically coupled to the proximal attachment 135 so that proximally directed forces exerted on the proximal attachment 135 are conveyed to the safeguard control element actuator 138. To that effect, for example, the shaft 122 extends partially in the body passageway 34 and secured to the safeguard control element actuator 138 so as to be jointly movable therewith. The safeguard control element actuator 138 moves in a proximal direction when the safeguard control element actuator 138 moves from the safeguard control element deactivated configuration to the safeguard control element activated configuration. The safeguard control element actuator 138 biased in a distal direction so that the safeguard control element actuator 138 remains in the safeguard control element deactivated configuration unless the predetermined overload force is exerted on the proximal attachment 135.

The safeguard control element actuator 138 is mechanically coupled to the inner control element 66*a* for moving the inner control element 66*a* in a proximal direction when the safeguard control element actuator 138 is moved from the safeguard control element deactivated configuration to the safeguard control element activated configuration. For example, this coupling is achieved as follows. The inner control element 66*a* defines a laterally extending inner control element-to-safeguard coupler 144. In a very specific example of implementation, the inner control element 66*a* is hollow at least over part thereof and defines a recess 140 extending longitudinally thereinto from the inner control element proximal end 142 thereof and the inner control element-to-safeguard coupler 144 extends laterally across the recess 140. The safeguard control element actuator 138 defines a substantially longitudinally elongated control element actuator slot 146 receiving the inner control element-to-safeguard coupler 144 thereinto, the control element actuator slot 146 defining an actuator slot proximal end 148 and a substantially longitudinally opposed actuator slot distal end 150.

In the safeguard control element deactivated configuration, the inner control element-to-safeguard coupler 144 is movable along the control element actuator slot 146. In the safeguard control element activated configuration, the inner control element-to-safeguard coupler 144 abuts against the actuator slot distal end 150 and the safeguard control element actuator 138 pulls on the inner control element 66*a* to move the dog control element 26 to the released configuration.

Biasing of the safeguard control element actuator 138 towards the safeguard control element deactivated configuration is achieved for example as follows. The overshot body 16 defines a safeguard flange 152 provided in the body passageway 34 proximally relative to the safeguard control element actuator 138. The safeguard flange 152 is either integral to the overshot body 30 or made of a separate element secured thereto. The overload safeguard 104 includes a stack of Belleville washers 154 extending between the safeguard flange 152 and the safeguard control element actuator 138 for biasing the safeguard control element actuator towards the body distal end 32. Once the predetermined force is achieved, the Belleville washers 154 collapse, which allows movement of the safeguard control element actuator 138 towards the safeguard control element activated configuration. The force required to collapse the Belleville washers 154 is larger than the force required to collapse the biasing element 73 so that operation of the dog control element 26 does not trigger operation of the overload safeguard 104.

Figure 10:
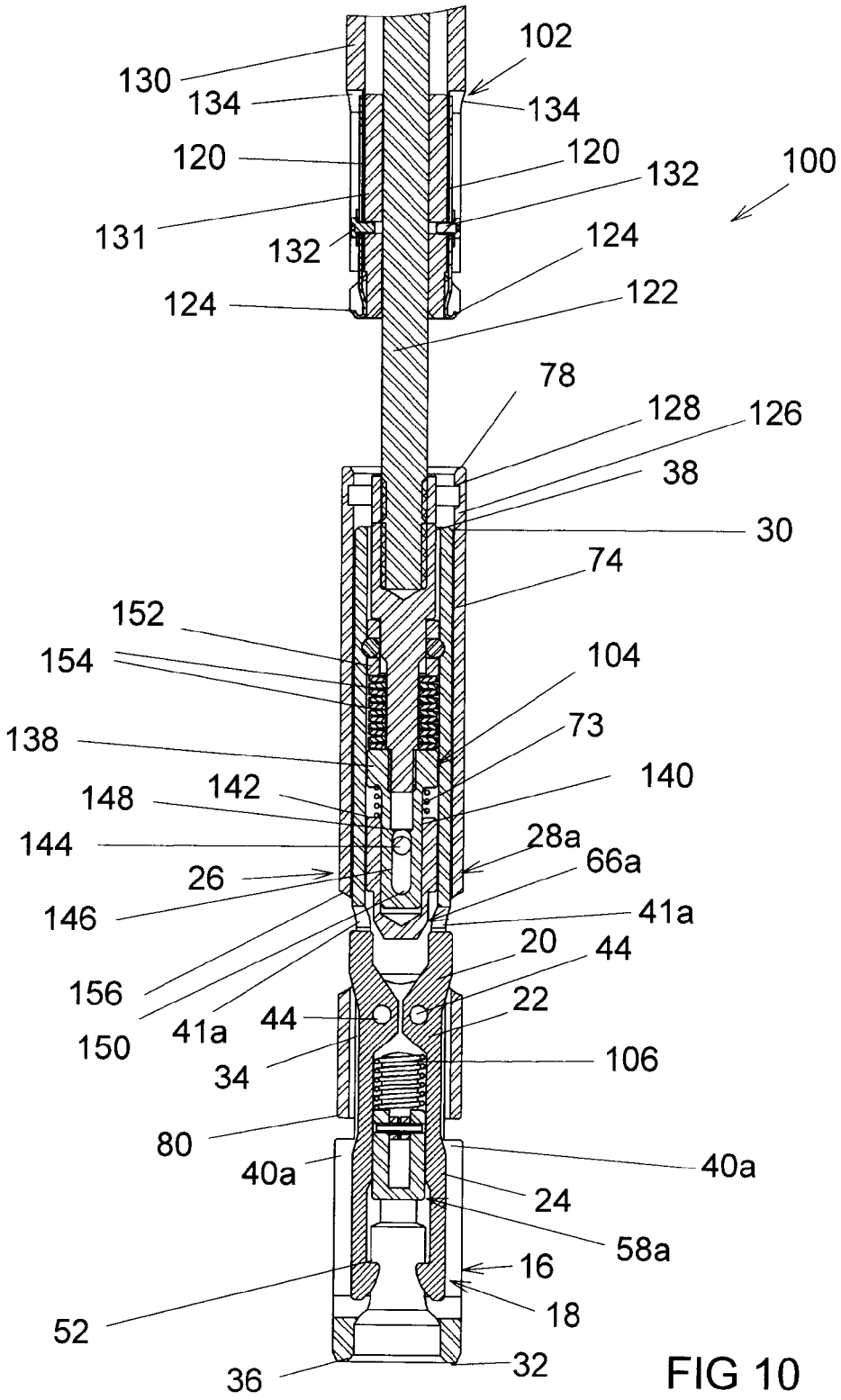
FIG. 10, in a side cross-sectional view, illustrates the overshot shown in FIGS. 8 and 9, the overshot being shown with the dog control element in the armed configuration, with the remote unlocking actuator thereof in the remote actuator inactive configuration and with the safeguard control element actuator in the safeguard control element deactivated configuration.

Referring for example to FIG. 10, the outer control element 28*a* is sleeve-shaped and defines a pair of control element apertures 156 extending laterally therethrough, the purpose of which is detailed hereinbelow. In the armed and locked configurations, control element apertures 156 are in register with the dog proximal sections 20 that themselves protrude in the control element apertures 156. In the released configuration, the control element apertures 156 are not in register with the dog proximal sections, which forces the lifting dogs 18 in the dog open configuration.

Also, instead of a simple pair of dog receiving apertures 40, the overshot 100 includes a pair of distal dog receiving apertures 40*a* and a pair of proximal dog receiving apertures 41*a*, all extending substantially laterally outwardly from the body passageway 34 through the overshot body 16. The lifting dogs 18 are pivotally mounted such that the dog distal sections 24 are movable substantially laterally through the distal dog receiving apertures 40*a* and the dog proximal sections 20 are movable substantially laterally through the proximal dog receiving apertures 41*a*.

In use, when the overshot 100 is lifted from a downhole location, if for any reasons, the equipment 12 becomes jammed, the safeguard control element 104 is moved to the safeguard control element activated configuration when a sufficient force is exerted thereonto by the cable 136. This moves the dog control element 26 to the released configuration, which in turn releases the spearhead point 14 and allows retrieval of the overshot 100, which allows the use of conventional equipment to try to remove the jammed equipment 12.

FIGS. 17 to 22 illustrate an overshot 200 in accordance with another alternative embodiment of the present invention. In FIGS. 17 to 22, reference numerals that were used in the description of the overshots 10 and 100 designate components that are substantially similar in shape and function in both overshots 10 and 200. Parts designated with the letter "b" added designate parts of the overshot 200 that have a function similar to the of the part having the same number, but without the "b", in the overshot 10, but which perform this function differently. Hereinbelow, only the differences between the overshots 10 and 100 and the overshot 200 are described in details.

Figure 19:
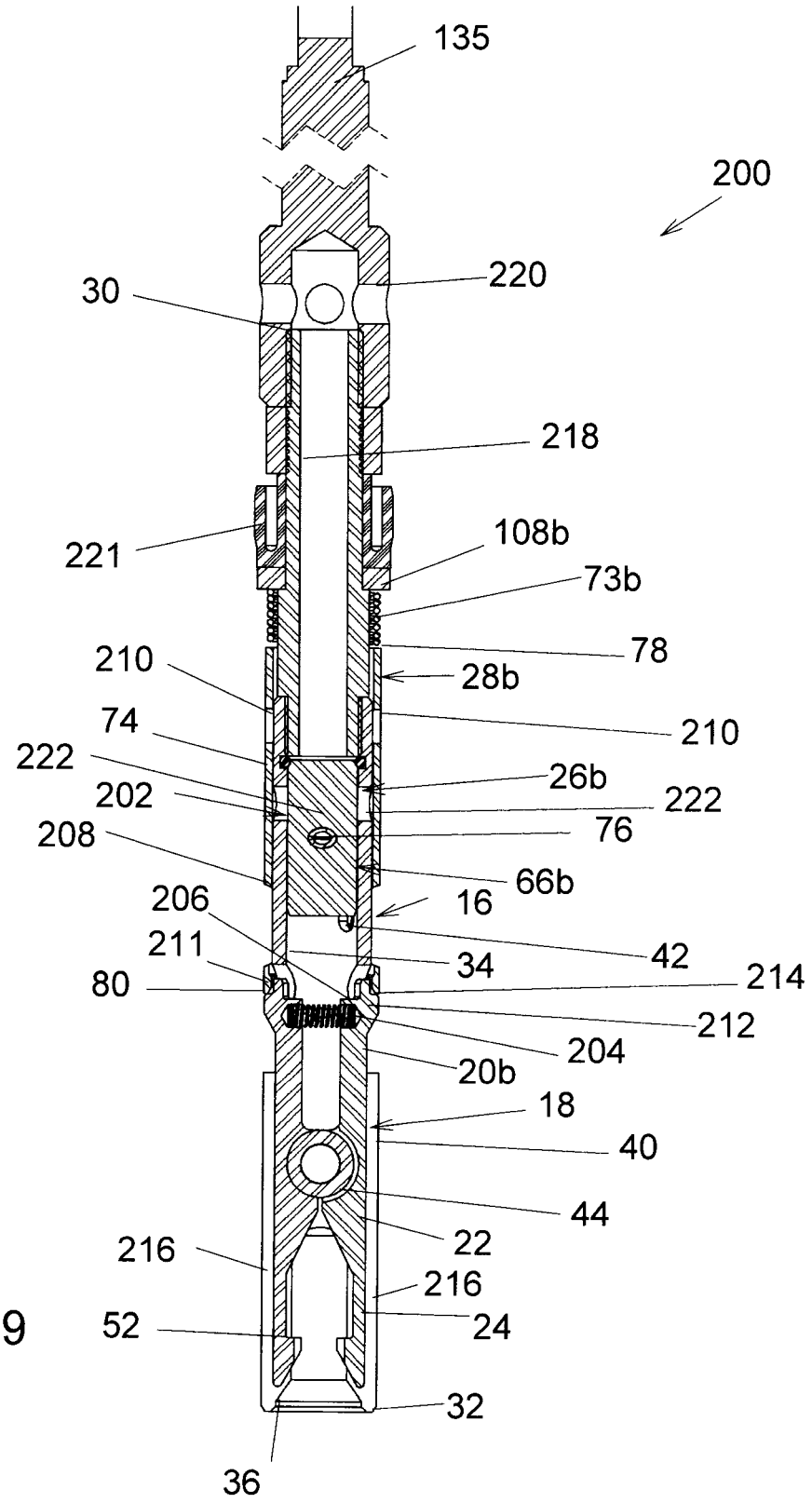
FIG. 19, in a side cross-sectional view, illustrates the overshot shown in FIGS. 17 and 18, the overshot being shown with the dog control element in the armed configuration.
Figure 20:
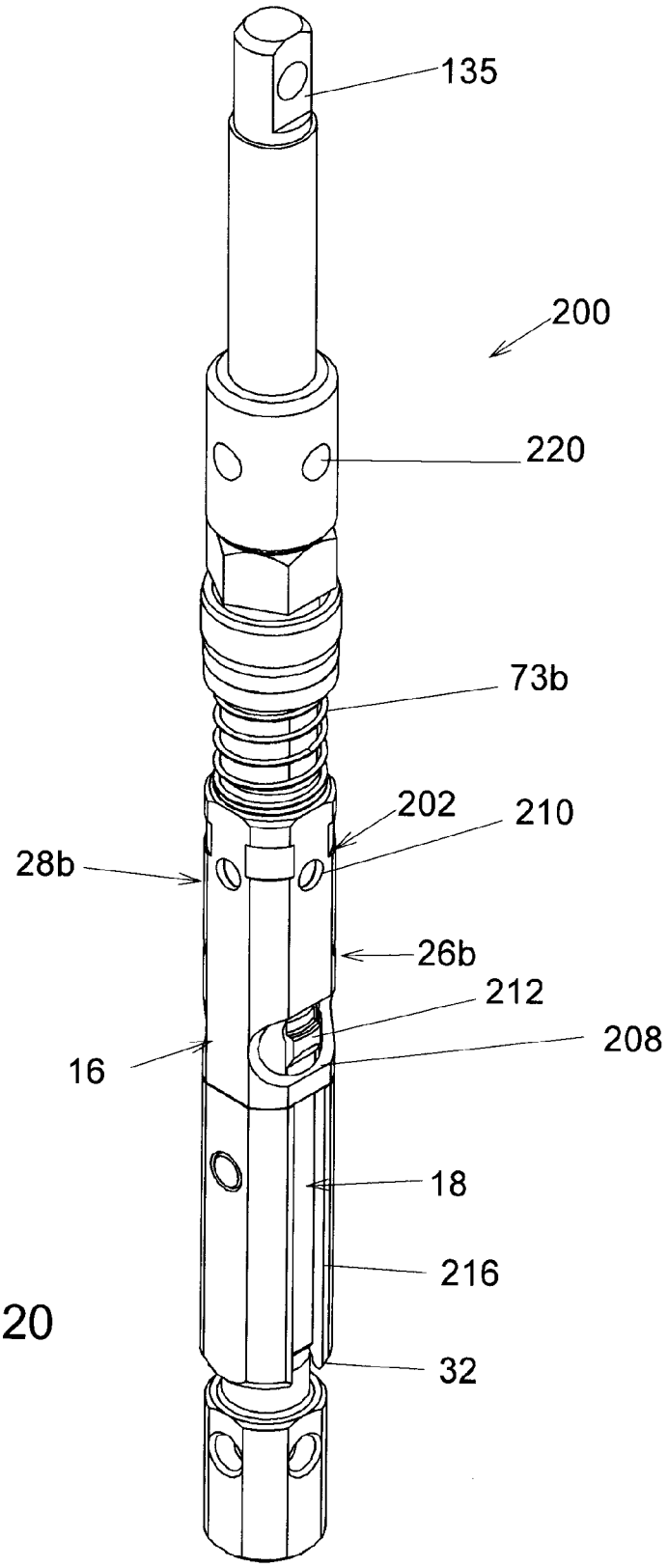
FIG. 20, in a perspective view, illustrates and overshot the overshot shown in FIGS. 17 to 19, the overshot being shot with the dog control element in the locked configuration.
Figure 21:
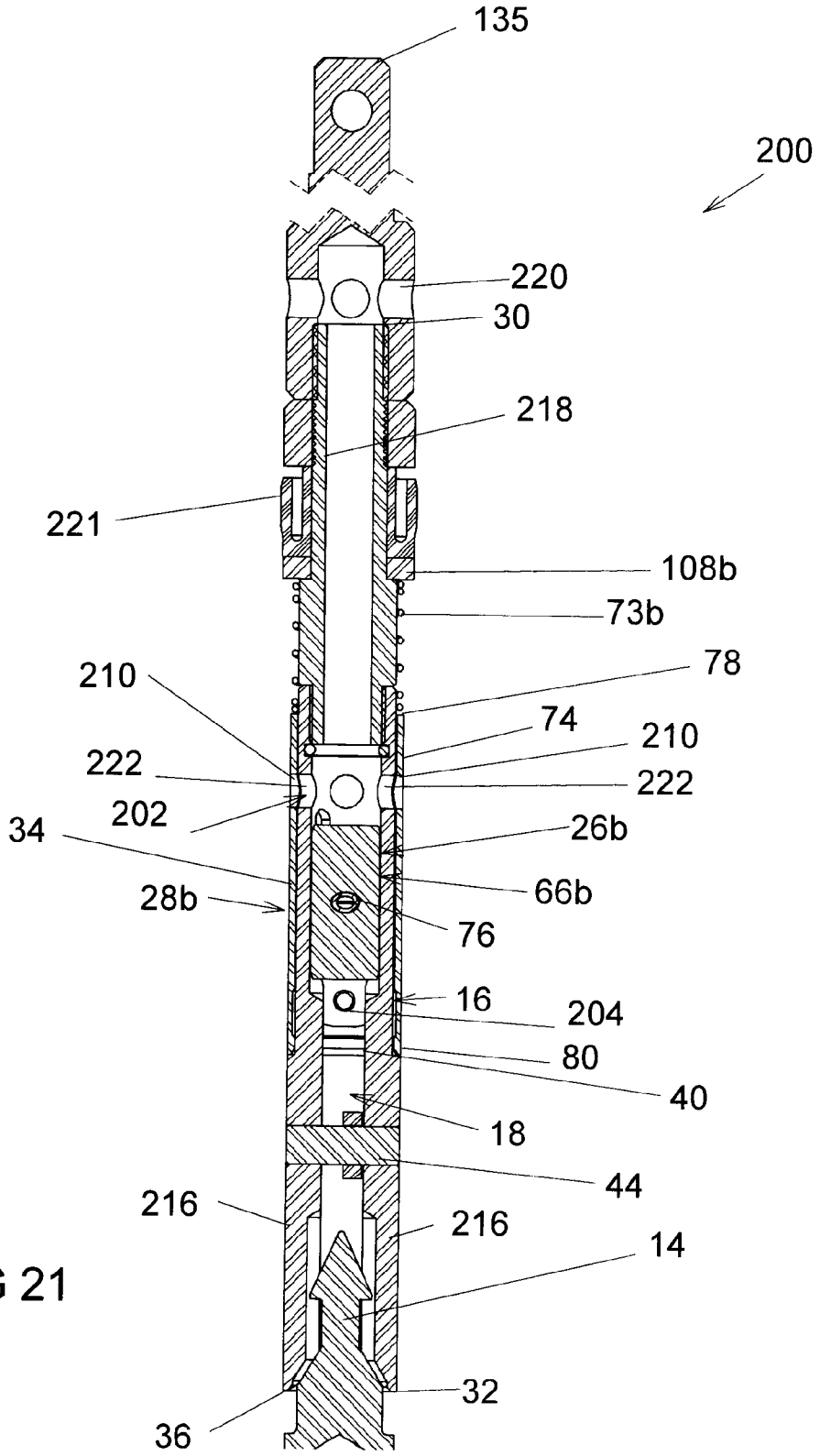
FIG. 21, in a front cross-sectional view, illustrates the overshot shown in in FIGS. 17 to 20, the overshot being shown with the dog control element in the locked configuration.

As seen for example in FIG. 19, the overshot 200 differs from the overshot 10 by having a different dog control element 26*b*. Also, the overshot 200 includes a valve 202. Furthermore, the lifting dogs 18 are coupled to each other by a biasing element 204 extending therebetween.

The biasing element 204 is operatively coupled to the lifting dogs 18 for biasing the lifting dogs towards the dog closed configuration. To that effect, the biasing element 204 takes the form of a coil spring extending between and attached to the dog proximal sections 20.

The dog control element 26*b* differs in many aspects from the dog control element 26. While the dog control element 26*b* includes an inner control element 66*b* jointly movable with an outer control element 28*b* as in the dog control element 26, the inner and outer control elements 66*b* and 28*b* differ in shape from the inner and outer control elements 66 and 28.

Figure 22:
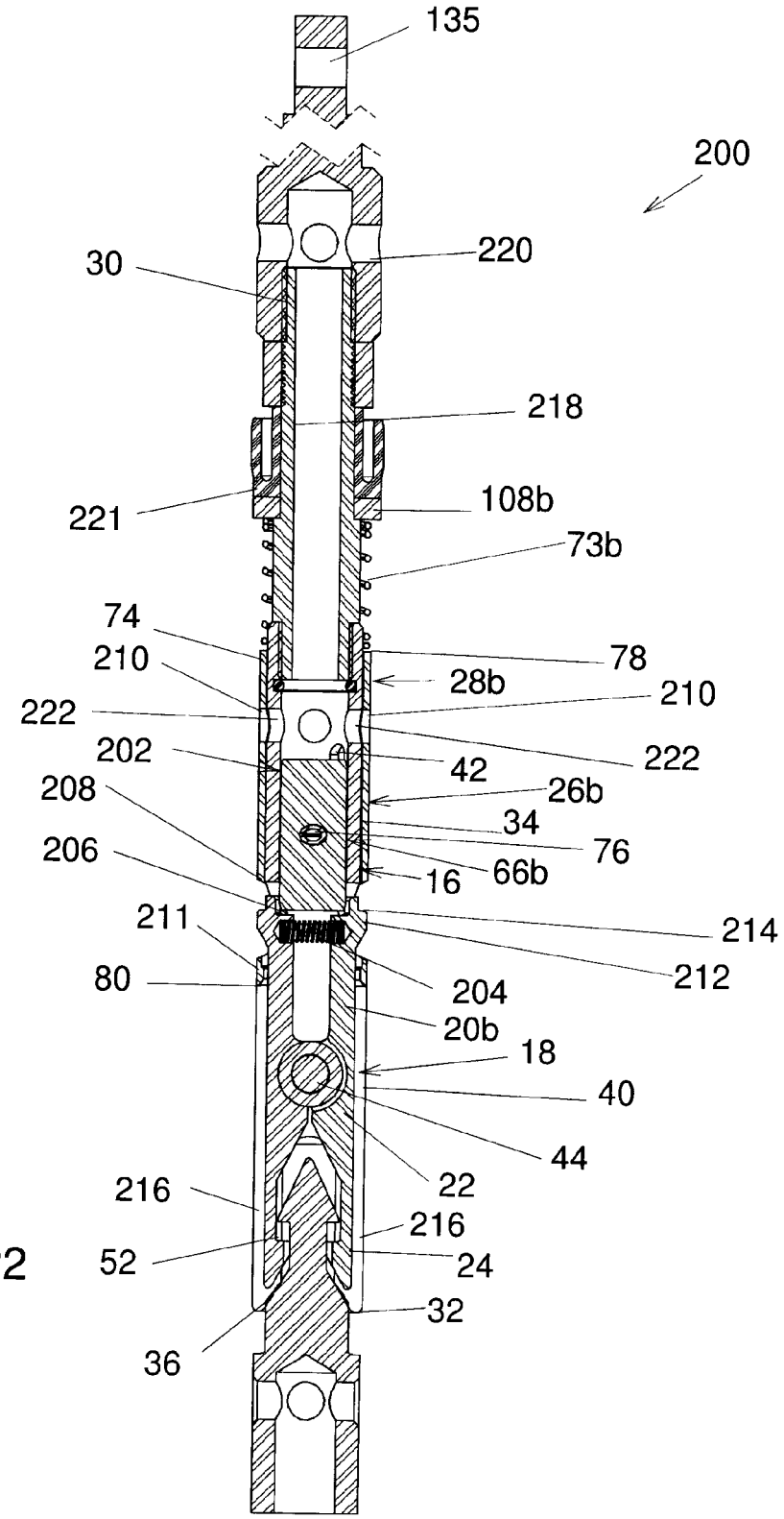
FIG. 22, in a side cross-sectional view, illustrates the overshot shown in FIGS. 17 to 21, the overshot being shown with the dog control element in the released configuration.

First, the inner control element 66*b* is configured and sized to prevent the lifting dogs 18 from achieving the dog open configuration when moved between the dog proximal sections 20, which achieves the locked configuration as seen in FIG. 22. To that effect, the dog proximal sections 20 abut against the inner control element 66*b* when the inner control element 66*b* is inserted therebetween with the lifting dogs 18 in the dog closed configuration. In the armed and released configurations, the inner control element 66*b* is completely retracted from between the lifting dogs, as seen in FIG. 19 for the armed configuration. Also, movement of the inner control element 66*b* towards the distal direction is limited by the shape of the dog proximal sections 20*b* that define an inner ledge 206 extending generally perpendicularly to the overshot body 16 in the dog closed configuration. Furthermore, the inner control element 66*b* is not itself directly biased towards the distal direction.

The outer control element 28*b* is sleeve-shaped and defines a pair of control element apertures 208 and four fluid flow apertures 210 all extending laterally therethrough, the purpose of which is detailed hereinbelow. In alternative embodiments of the invention, the number of fluid flow apertures 210 is less than or greater than four. The control element apertures 208 are distally located relative to the fluid flow apertures 210. The outer control element 28*b* defines an outer control element distal end section 211 provided distally relative to the control element apertures 208.

The outer control element 28*b* is biased distally by a biasing element 73*b* taking the form for example of a coil spring provided outside of the overshot body and extending between a laterally outwardly extending flange 108*b*, extending laterally outwardly from the overshot body 16 proximally relative to the outer control element 28*b*, and the outer control element 28*b*. In the armed configuration, movement of the outer control element 28*b* towards the distal direction is limited by the shape of the dog proximal sections 20*b* that define a laterally extending dog protrusion 212, the dog protrusion 212 extending laterally outside of the overshot body 16 when the lifting dogs 18 are in the dog closed configuration. The dog protrusion 212 is retracted in the overshot body 16 when the lifting dogs 18 are in the dog open configuration. More specifically, the dog protrusion 212 defines an outer ledge 214 extending substantially perpendicularly to the overshot body 16 and laterally outwardly relative thereto in the dog closed configuration.

In the armed configuration, the outer control element distal end section 211 is in register with the dog proximal section 20*b* proximally relative to the dog protrusions 212 and abuts against the outer ledge 214. In the locked configuration, the outer control element distal end section 211 is in register with the dog proximal sections 20*b* distally relative to the dog protrusion 212 and the control element apertures 208 receive the dog protrusions 212. In the released configuration, the outer control element distal end section 211 is in register with the dog protrusions 212, thereby moving the lifting dogs 18 to the dog open configuration.

Furthermore, the overshot body 16 defines a body distal end section 216 that protrudes laterally outwardly to an extent preventing the outer control element 28*b* from moving distally past the body distal end section 216. Also, as seen for example in FIG. 21, in some embodiments of the invention, the body distal end section 216 is configured and sized for abutting against the spearhead point 14 when the spearhead point 14 is inserted between the lifting dogs 18.

The sleeve-to-locking element couplers 76 are not well seen in FIGS. 17 to 22 as they are oriented obliquely with the plane in which cross-sections are taken. The sleeve-to-locking element couplers 76 are nevertheless present to couple the inner and outer control elements 66*b* and 28*b* to each other.

In use, the overshot 200 is configured with the dog control element 26*b* in the armed configuration. When the spearhead point 14 is inserted between the lifting dogs 18, the lifting dogs 18 are moved to the dog open configuration and the dog protrusions 212 are retracted, which allows movement of the outer control element 28*b* distally so that the locked configuration is achieved. To release the spearhead point, moving the outer control element 28*b* proximally from the locked configuration moves the outer control element distal end section 211 in register with the dog protrusions 212, which moves the lifting dogs 18 to the dog open configuration in which the spearhead point 14 can be removed.

The valve 202 controls flow of a fluid across the overshot 200. To that effect, the overshot 200 defines a fluid flow passageway 218 extending longitudinally in the overshot 200 from substantially adjacent the body proximal end 32 and emerging laterally from the overshot 200 at a location proximal relative to the body distal end 32. For example, laterally extending inlet apertures 220 are provided adjacent the body proximal end 32 and lead into the fluid flow passageway 218. Laterally extending outlet apertures 222 extend laterally through the overshot body 16 from the fluid flow passageway 218 opposed to the inlet apertures 220. Typically, a seal 221 is provided outside of the overshot body 16 for sealing against the wall of the bore (not shown in the drawings). The seal 221 is provided between the inlet and outlet apertures 220 and 222 and extends laterally outwardly to a greater extent than the remainder of the overshot 200.

The valve 202 is movable between a valve open position and a valve closed position for respectively selectively allowing and preventing flow of a fluid through the fluid flow passageway 218. An advantageous valve 202 is configured so that the valve 202 is in the valve open position when the dog control element 26*b* is in the locked configuration and the valve 202 is in the valve closed position when dog control element 26*b* is in the armed configuration.

For example, this is achieved by having the inner control element 66*b* movable substantially longitudinally and configured and sized such that the inner control element 66*b* is inserted in the fluid flow passageway 218 when the valve 202 is in the valve closed position and the inner control element 66*b* is retracted from the fluid flow passageway 218 when the valve 202 is in the valve closed position. Also, in some embodiments of the invention, the outer control element 28*b* extends proximally such that the fluid flow apertures 210 are in register with outlet apertures 222 when the valve 202 is in the valve closed position and the fluid flow apertures 210 are retracted from the outlet apertures 222 when the valve 202 is in the valve open position.

In use, the overshot 200 including the valve 202 is usable to push the overshot 200 through a bore hole using a fluid. First, the dog control element 26*b* is moved to the armed configuration, which moves the valve 202 to the valve closed position. Then, the overshot 200 is inserted in the bore hole and the fluid is pushed under pressure in the bore hole. Since the valve 202 is in the valve closed configuration, the fluid exerts a force on the overshot 200, which is able to push the overshot 200 in non-downwardly oriented sections of the bore hole. When the overshot 200 latches to the spearhead point 14, the dog control element is moved to the locked configuration, which moves the inner and outer control elements 66*b* and 28*b* distally and moves the valve 202 to the valve open configuration. After the fluid is no longer pressurised in the bore hole, the fluid flow passageway 218 allows removal of the overshot 200 from the bore hole without having to lift the whole water column that is located proximally thereto as the fluid can then flow across the overshot 200.

The overshots 10, 100 and 200 all include many features. The reader skilled in the art will readily appreciate that these features can be mixed together in different manners without departing from the scope of the invention. Also, although the present invention has been described hereinabove by way of preferred embodiments thereof, it can be modified, without departing from the spirit and nature of the subject invention as defined in the appended claims.

What is claimed is:

1. An overshot for handling equipment defining a spearhead point, said overshot comprising:

a substantially elongated overshot body defining a body proximal end and a substantially longitudinally opposed body distal end;

a pair of lifting dogs, said lifting dogs being substantially elongated and extending along said overshot body, said lifting dogs defining each a dog proximal section, a dog distal section substantially opposed thereto and a dog intermediate section extending therebetween, said lifting dogs being pivotally mounted to said overshot body in said dog intermediate section so as to be movable between a dog closed configuration and a dog open configuration, said dog distal sections being configured and sized for allowing latching of said spearhead point therebetween when said lifting dogs are in said dog closed configuration, said dog distal sections being spread apart from each other to a greater extent in said dog open configuration than in said dog closed configuration for allowing substantially free movements of said spearhead point therebetween; and a dog control element operatively coupled to said lifting dogs for selectively controlling the movement of said lifting dogs between said dog closed and open configurations, said dog control element being operable between an armed configuration, a locked configuration and a released configuration, said armed, locked and released configurations differing from each other, wherein in said armed configuration, said lifting dogs are movable between said dog closed and open configurations for allowing insertion of said spearhead point therebetween;

in said locked configuration, said lifting dogs are locked in said dog closed configuration; and in said released configuration, said lifting dogs are positioned in said dog open configuration;

said dog control element including a trigger operative for automatically configuring said dog control element from said armed configuration to said locked configuration when said spearhead point is latched between said dog distal sections with said dog control element in said armed configuration.

2. The overshot as defined in claim 1, further comprising a biasing element operatively coupled to said lifting dogs for biasing said lifting dogs towards said dog closed configuration.

3. The overshot as defined in claim 2, wherein said dog control element includes an outer control element provided outside of said overshot body operative for selectively limiting outwardly directed movements of said dog proximal sections, said outer control element being movable substantially longitudinally along said overshot body, said outer control element being distally biased;

said outer control element defines a pair of control element apertures extending laterally therethrough, said outer control element defining an outer control element distal end section provided distally relative to said control element apertures;

said lifting dogs define each a laterally extending dog protrusion in said dog proximal section, said dog protrusion extending laterally outside of said overshot body when said lifting dogs are in said dog closed configuration, said dog protrusion being retracted in said overshot body when said lifting dogs are in said dog open configuration, said dog protrusion defining a ledge extending substantially perpendicularly to said overshot body and laterally outwardly relative thereto in said dog closed configuration;

in said armed configuration, said outer control element distal end section is in register with said dog proximal section proximally relative to said dog protrusion and abuts against said ledge;

in said locked configuration, said outer control element distal end section is in register with said dog proximal section distally relative to said dog protrusion and said control element apertures receive said dog protrusions;

in said released configuration, said outer control element distal end section is in register with said dog protrusion, thereby moving said lifting dogs to said dog open configuration.

4. The overshot as defined in claim 1, wherein said dog control element automatically achieves said armed configuration when said dog control element is moved to said released configuration and is subsequently released.

5. The overshot as defined in claim 1, wherein said trigger is movable along said overshot body, said spearhead point abutting against said trigger and moving said trigger towards said body proximal end when said spearhead point is inserted between said lifting dogs, movement of said trigger towards said body proximal end causing said dog control element to achieve said locked configuration.

6. The overshot as defined in claim 5, wherein said trigger is at least in part provided between said dog distal sections.

7. The overshot as defined in claim 1, wherein said dog control element includes an outer control element operative for selectively limiting outwardly directed movements of said dog proximal sections.

8. The overshot as defined in claim 1, wherein said dog control element includes an inner control element operative for selectively limiting inwardly directed movements of said dog proximal sections.

9. The overshot as defined in claim 1, wherein said dog control element includes an outer control element operative for selectively limiting outwardly directed movements of said dog proximal sections and an inner control element operative for selectively limiting inwardly directed movements of said dog proximal sections.

10. The overshot as defined in claim 9, wherein said outer control element is movable substantially longitudinally along said overshot body, said outer control element defining an outer control element first section and an outer control element second section, said outer control element first and second sections being provided laterally outwardly relative to said lifting dogs and longitudinally offset relative to each other, said outer control element first section being configured and sized to allow said lifting dogs to achieve said dog closed configuration when moved in register with said dog proximal sections, said outer control element second section being configured and sized to force said lifting dogs to achieve said dog open configuration when moved in register with said dog proximal sections.

11. The overshot as defined in claim 10, wherein said outer control element first section is proximally located relative to said outer control element second section.

12. The overshot as defined in claim 10, wherein said outer control element includes a sleeve movable longitudinally along said overshot body.

13. The overshot as defined in claim 12, wherein said sleeve has a larger inner diameter in said outer control element first section than in said outer control element second section.

14. The overshot as defined in claim 9, wherein said inner control element is movable substantially longitudinally along said overshot body and defines an inner control element first section and an inner control element second section, said inner control element first and second sections being substantially longitudinally offset relative to each other and provided laterally inwardly relative to said lifting dogs, said inner control element first section being configured and sized to prevent said lifting dogs from achieving said dog open configuration when moved in register with said dog proximal sections, said inner control element second section being configured and sized to allow said lifting dogs to achieve said dog open configuration when moved in register with said dog proximal sections with said inner control element first section retracted from between said dog proximal sections.

15. The overshot as defined in claim 14, wherein said inner control element first section is proximally located relative to said inner control element second section.

16. The overshot as defined in claim 15, wherein said inner control element extends laterally outwardly to a greater extent in said inner control element first section than in said inner control element second section in a plane including said lifting dogs.

17. The overshot as defined in claim 9, wherein said inner control element is configured and sized to prevent said lifting dogs from achieving said dog open configuration when moved between said dog proximal sections.

18. The overshot as defined in claim 17, wherein said dog proximal sections abut against said inner control element when said inner control element is inserted therebetween with said lifting dogs in said dog closed configuration.

19. The overshot as defined in claim 9, wherein said inner and outer control elements are jointly movable longitudinally along said overshot body.

20. The overshot as defined in claim 19, wherein said inner and outer control elements are biased towards said body distal end.

21. The overshot as defined in claim 20, wherein said dog control element includes an arming element operative for selectively preventing movement of said inner and outer control elements towards said body distal end when said inner and outer control elements are positioned proximally to a predetermined longitudinal position so as to maintain said dog control element in said armed configuration.

22. The overshot as defined in claim 21, wherein said arming element includes a trigger and a locking element;

said trigger is movable between a trigger first position and a trigger second position, said trigger being configured and sized for moving from said trigger first position to said trigger second position when said spearhead point is inserted between said lifting dogs;

said locking element is movable between a locking element extended position and a locking element retracted position, said locking element being in said locking element extended position when said trigger is in said trigger first position and said locking element being in said locking element retracted position when said trigger is in said trigger second position;

in said locking element extended position, said locking element extends across a path of travel of said outer control element as said outer control element moves from an outer element proximalmost position to an outer element distalmost position, and in said locking element retracted position, said locking element is retracted from said path of travel;

whereby, when said trigger moves from said trigger first position to said trigger second position, said locking element moves from said locking element extended position to said locking element retracted position, thereby allowing distally oriented movements of said outer control element beyond said predetermined longitudinal position to configure said dog control element to said locked configuration.

23. The overshot as defined in claim 22, wherein said trigger includes a spearhead receiving section provided between said lifting dogs for receiving part of said spearhead point, a trigger released section provided proximally with respect to said spearhead receiving section and a trigger engaged section provided proximally with respect to said trigger released section;

said locking element includes a pin provided laterally outwardly with respect to said trigger released and engaged sections, said pin being moved between a pin retracted position and a pin extended position when said locking element is moved respectively to said locking element retracted and extended positions such that said pin is respectively retracted from and extending across said path of travel of said outer control element, said pin being biased towards said trigger and abutting thereagainst;

said trigger extends towards said pin to a greater extent in said trigger engaged section than in said trigger released section;

whereby moving said trigger between said trigger first and second positions moves respectively said trigger engaged and released sections in register with said pin to move said pin respectively to said pin extended and retracted positions.

24. The overshot as defined in claim 23, wherein said trigger defines a trigger transition section extending between said trigger engaged and released sections, said trigger transition section defining a slanted surface obliquely oriented relative to said overshot body and providing a smooth transition between said trigger engaged and released sections to guide said pin therealong as said trigger is moved between said trigger first and second positions.

25. The overshot as defined in claim 24, wherein said spearhead receiving section defines a spearhead receiving recess extending longitudinally thereinto for receiving an apex of said spearhead point thereinto.

26. The overshot as defined in claim 22, wherein said trigger is biased towards said trigger first position;

said locking element includes a wing, said wing defining a wing proximal end and a substantially opposed wing distal end, said wing being pivotally mounted to said trigger substantially adjacent said wing proximal end;

said overshot body defines a wing receiving passageway extending laterally therethrough, said wing being mounted in said wing receiving passageway;

said wing distal end protrudes from said wing receiving passageway when said trigger is in said trigger first position and said wing distal end is retracted in said wing receiving passageway when said trigger is in said trigger second position.

27. The overshot as defined in claim 9 wherein said dog intermediate and distal sections are substantially rectilinear and substantially collinear with each other.

28. The overshot as defined in claim 9, wherein said dog distal section is substantially hook shaped and defines a spearhead receiving recess, said spearhead receiving recesses of said lifting dogs facing each other and being provided for receiving said spearhead point therebetween.

29. The overshot as defined in claim 9, wherein said dog proximal section is substantially V-shaped and includes proximal section first and second segments, said proximal section first segment extending from said dog intermediate section and said proximal section second segment extending from said proximal section first segment, said proximal section second segment being substantially parallel to said dog distal section and being provided at a laterally outward location relatively thereto.

30. The overshot as defined in claim 1, wherein said overshot defines a fluid flow passageway extending longitudinally in said overshot from substantially adjacent said body proximal end and emerging laterally from said overshot at a location proximal relative to said body distal end, said overshot further comprising a valve movable between a valve open position and a valve closed position for respectively selectively allowing and preventing flow of a fluid through said fluid flow passageway.

31. The overshot as defined in claim 30, wherein said valve is in said valve open position when said dog control element is in said locked configuration and said valve is in said valve closed position when dog control element is in said armed configuration.

32. The overshot as defined in claim 31, wherein said dog control element includes an inner control element movable substantially longitudinally relative to said overshot body to selectively limit inwardly directed movements of said dog proximal sections, said inner control element being inserted in said fluid flow passageway when said valve is in said valve closed position and said inner control element being retracted from said fluid flow passageway when said valve is in said valve open position.

33. The overshot as defined in claim 1, further comprising a proximal attachment for attaching a cable thereto and an overload safeguard operatively coupled to said proximal attachment and to said dog control element for automatically configuring said dog control element from said locked configuration to said released configuration when a proximally oriented force larger than a predetermined overload force is exerted on said proximal attachment by said cable.

34. The overshot as defined in claim 33, wherein said overload safeguard includes a safeguard control element actuator operatively coupled to said dog control element to move said dog control element to said released configuration when said proximally oriented force larger than said predetermined overload force is exerted on said proximal attachment, said safeguard control element actuator being movable between a safeguard control element deactivated configuration and a safeguard control element activated configuration, wherein, in said safeguard control element deactivated configuration, said dog control element is free to move between said armed and locked configurations, and, in said safeguard control element activated configuration, said dog control element is forced to achieve said released configuration.

35. The overshot as defined in claim 34, wherein said dog control element includes an outer control element to selectively limit outwardly directed movements of said dog proximal sections and an inner control element to selectively limit inwardly directed movements of said dog proximal sections, said inner and outer control elements being jointly movable longitudinally along said overshot body as said dog control element is moved between said armed, locked and released configurations, said inner and outer control elements being proximally located when said dog control element is in said released configuration relative to when said dog control element is in said armed and locked configurations;

said safeguard control element actuator is movable longitudinally relative to said overshot body and mechanically coupled to said proximal attachment so that proximally directed forces exerted on said proximal attachment are conveyed to said safeguard control element actuator, said safeguard control element actuator moving in a proximal direction when said safeguard control element actuator moves from said safeguard control element deactivated configuration to said safeguard control element activated configuration, said safeguard control element actuator being biased in a distal direction so that said said safeguard control element actuator remains in said safeguard control element deactivated configuration unless said predetermined overload force is exerted on said proximal attachment;

said safeguard control element actuator is mechanically coupled to said inner control element for moving said inner control element in a proximal direction when said safeguard control element actuator is moved from said safeguard control element deactivated configuration to said safeguard control element activated configuration.

36. The overshot as defined in claim 35, wherein said inner control element defines a laterally extending inner control element-to-safeguard coupler;

said safeguard control element actuator defines a substantially longitudinally elongated control element actuator slot receiving said inner control element-to-safeguard coupler thereinto, said control element actuator slot defining an actuator slot proximal end and a substantially longitudinally opposed actuator slot distal end;

in said safeguard control element deactivated configuration, said inner control element-to-safeguard coupler is movable along said control element actuator slot; and in said safeguard control element activated configuration said inner control element-to-safeguard coupler abuts against said actuator slot distal end and said safeguard control element actuator pulls on said inner control element to move said dog control element to said released configuration.

37. The overshot as defined in claim 35, wherein said overshot body defines a body passageway extending longitudinally therethrough and a safeguard flange provided in said body passageway proximally relative to said safeguard control element actuator, said overload safeguard further comprising a stack of Belleville washers extending between said safeguard flange and said safeguard control element actuator for biasing said safeguard control element actuator towards said body distal end.

38. The overshot as defined in claim 1, further comprising a remote unlocking actuator for selectively moving said dog control element from said locked configuration to said released configuration.

39. The overshot as defined in claim 38, wherein said remote unlocking actuator is configurable in a remote actuator active configuration and in a remote actuator inactive configuration;

in said remote actuator active configuration, said remote unlocking actuator is operable to selectively move said dog control element from said locked configuration to said released configuration;

in said remote actuator inactive configuration, said remote unlocking actuator is inoperable to selectively move said dog control element from said locked configuration to said released configuration.

40. The overshot as defined in claim 39, wherein said dog control element includes an outer control element to selectively limit outwardly directed movements of said dog proximal sections, said outer control element being proximally located when said dog control element is in said released configuration relative to when said dog control element is in said armed and locked configurations;

said remote unlocking actuator is provided proximally relative to said outer control element and includes an outer control element coupler for coupling said remote unlocking actuator and said outer control element to each other so that said remote unlocking actuator and said outer control element are jointly movable, said remote unlocking actuator being movable longitudinally relative to said overshot body between an unlocking actuator disengaged position and an unlocking actuator engaged position, wherein, with said remote unlocking actuator in said remote actuator active configuration, in said unlocking actuator disengaged position, said remote unlocking actuator and said outer control element are movable independently from each other and in said unlocking actuator engaged position, said outer control element coupler is coupled to said outer control element so that said remote unlocking actuator and said outer control element are movable jointly.

41. The overshot as defined in claim 40, wherein said overshot body includes a longitudinally extending shaft provided proximally to said outer control element, said remote unlocking actuator being mounted to said shaft so as to be longitudinally movable therealong.

42. The overshot as defined in claim 41, wherein said outer control element coupler includes a hook attachable to said outer control element.

43. The overshot as defined in claim 42, wherein said outer control element includes a sleeve defining a sleeve outer wall and a sleeve flange extending radially inwardly from said sleeve outer wall, said hook being hookable to said sleeve flange.

44. The overshot as defined in claim 43, wherein said hook is movable between a hook retracted position wherein said hook is movable longitudinally relative to said sleeve flange when adjacent thereto and a hook extended position wherein said hook is hookable to said sleeve flange when positioned inside said sleeve distally relative to said sleeve flange.

45. The overshot as defined in claim 42, wherein said remote unlocking actuator includes a remote unlocking actuator body mounted to said shaft so as to be longitudinally movable therealong, said hook being mounted to said remote unlocking actuator body and positionable relative thereto between a hook active position and a hook inactive position;

in said hook active position, said remote unlocking actuator is in said remote actuator active configuration; and in said hook inactive position, said remote unlocking actuator is in said remote actuator inactive configuration.

46. An overshot for handling equipment defining a spearhead point, said overshot comprising:

a substantially elongated overshot body defining a body proximal end and a substantially longitudinally opposed body distal end;

a pair of lifting dogs, said lifting dogs being substantially elongated and extending along said overshot body, said lifting dogs defining each a dog proximal section, a dog distal section substantially opposed thereto and a dog intermediate section extending therebetween, said lifting dogs being pivotally mounted to said overshot body in said dog intermediate section so as to be movable between a dog closed configuration and a dog open configuration, said dog distal sections being configured and sized for allowing latching of said spearhead point therebetween when said lifting dogs are in said dog closed configuration, said dog distal sections being spread apart from each other to a greater extent in said dog open configuration than in said dog closed configuration for allowing substantially free movements of said spearhead point therebetween; and a dog control element operatively coupled to said lifting dogs for selectively controlling the movement of said lifting dogs between said dog closed and open configurations, said dog control element being operable between an armed configuration, a locked configuration and a released configuration, wherein in said armed configuration, said lifting dogs are movable between said dog closed and open configurations for allowing insertion of said spearhead point therebetween;

in said locked configuration, said lifting dogs are locked in said dog closed configuration; and in said released configuration, said lifting dogs are positioned in said dog open configuration;

said overshot further comprising a biasing element operatively coupled to said lifting dogs for biasing said lifting dogs towards said dog closed configuration;

said dog control element including an outer control element provided outside of said overshot body operative for selectively limiting outwardly directed movements of said dog proximal sections, said outer control element being movable substantially longitudinally along said overshot body, said outer control element being distally biased;

said outer control element defining a pair of control element apertures extending laterally therethrough, said outer control element defining an outer control element distal end section provided distally relative to said control element apertures;

said lifting dogs define each a laterally extending dog protrusion in said dog proximal section, said dog protrusion extending laterally outside of said overshot body when said lifting dogs are in said dog closed configuration, said dog protrusion being retracted in said overshot body when said lifting dogs are in said dog open configuration, said dog protrusion defining a ledge extending substantially perpendicularly to said overshot body and laterally outwardly relative thereto in said dog closed configuration;

in said armed configuration, said outer control element distal end section is in register with said dog proximal section proximally relative to said dog protrusion and abuts against said ledge;

in said locked configuration, said outer control element distal end section is in register with said dog proximal section distally relative to said dog protrusion and said control element apertures receive said dog protrusions;

in said released configuration, said outer control element distal end section is in register with said dog protrusion, thereby moving said lifting dogs to said dog open configuration.

* * * * *